US006522317B1

(12) United States Patent
Satou et al.

(10) Patent No.: US 6,522,317 B1
(45) Date of Patent: Feb. 18, 2003

(54) LIQUID-CRYSTAL DISPLAY APPARATUS INCORPORATING DRIVE CIRCUIT IN SINGLE INTEGRATED ASSEMBLY

(75) Inventors: Hideo Satou, Hitachi (JP); Yoshiro Mikami, Hitachiohta (JP); Hiroshi Kageyama, Hitachi (JP); Takahiro Nagano, Hitachi (JP); Yoshinori Aono, Hitachi (JP); Toshio Miyazawa, Chiba (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/497,679

(22) Filed: Feb. 4, 2000

(30) Foreign Application Priority Data

Feb. 5, 1999 (JP) ..... 11-028116
Aug. 3, 1999 (JP) ..... 11-219570

(51) Int. Cl.[7] ..... G09G 3/36; G09G 5/00

(52) U.S. Cl. ..... 345/98; 345/99; 345/100; 345/103; 345/205; 345/206

(58) Field of Search ..... 345/87–103, 204–214

(56) References Cited

U.S. PATENT DOCUMENTS 5,170,158 A * 12/1992 Shinya ..... 345/204
5,874,934 A * 2/1999 Ito ..... 345/100
6,049,321 A * 4/2000 Sasaki ..... 345/100
6,160,533 A * 12/2000 Tamai et al. ..... 345/89
6,175,351 B1 * 1/2001 Matsuura et al. ..... 345/98
6,191,779 B1 * 2/2001 Taguchi et al. ..... 341/144

* cited by examiner

*Primary Examiner*—Steven Saras
*Assistant Examiner*—Amr Awad
(74) *Attorney, Agent, or Firm*—Antonelli, Terry, Stout, & Kraus, LLP

(57) ABSTRACT

A liquid-crystal display apparatus includes first and second substrates sandwiching a liquid-crystal, and having a switching element provided at a cross point of a scan line and a data line on the first substrate, a vertical drive circuit for controlling a voltage of the scan line provided on the first substrate, a horizontal drive circuit for controlling a voltage of said data line provided on the first substrate, and a transparent electrode provided on a surface of the second substrate. The horizontal drive circuit includes a reference-voltage generator, a voltage selector, a controller, and a sample-and-hold arrangement.

3 Claims, 15 Drawing Sheets

| T1 | Dn-1 | D2 | D1 | D0 | 0 | 1 | 2 | 3 | 4 | $2^n-3$ | $2^n-2$ | $2^n-1$ |
|---|---|---|---|---|---|---|---|---|---|---|---|---|
| L | L | L | L | L | H | L | L | L | L | L | L | L |
| L | L | L | L | H | L | H | L | L | L | L | L | L |
| L | L | L | H | L | L | L | H | L | L | L | L | L |
| L | L | L | H | H | L | L | L | H | L | L | L | L |
| L | L | H | L | L | L | L | L | L | H | L | L | L |
| L | H | H | L | L | L | L | L | L | L | L | L | L |
| L | H | H | L | H | L | L | L | L | L | H | L | L |
| L | H | H | H | L | L | L | L | L | L | L | H | L |
| L | H | H | H | H | L | L | L | L | L | L | L | H |
| H | L | L | L | L | H | H | L | L | L | L | L | L |
| H | L | L | L | H | H | H | L | L | L | L | L | L |
| H | L | L | H | L | L | L | H | H | L | L | L | L |
| H | L | L | H | H | L | L | H | H | L | L | L | L |
| H | L | H | L | L | L | L | L | L | H | L | L | L |
| H | H | H | L | L | L | L | L | L | L | H | L | L |
| H | H | H | L | H | L | L | L | L | L | H | L | L |
| H | H | H | H | L | L | L | L | L | L | L | H | H |
| H | H | H | H | H | L | L | L | L | L | L | H | H |

| T1 | D2 | D1 | D0 | X0 | X1 | X2 | X3 | X4 | X5 | X6 | X7 |
|---|---|---|---|---|---|---|---|---|---|---|---|
| L | L | L | L | H | L | L | L | L | L | L | L |
| L | L | L | H | L | H | L | L | L | L | L | L |
| L | L | H | L | L | L | H | L | L | L | L | L |
| L | L | H | H | L | L | L | H | L | L | L | L |
| L | H | L | L | L | L | L | L | H | L | L | L |
| L | H | L | H | L | L | L | L | L | H | L | L |
| L | H | H | L | L | L | L | L | L | L | H | L |
| L | H | H | H | L | L | L | L | L | L | L | H |
| H | L | L | L | H | H | L | L | L | L | L | L |
| H | L | L | H | H | H | L | L | L | L | L | L |
| H | L | H | L | L | L | H | H | L | L | L | L |
| H | L | H | H | L | L | H | H | L | L | L | L |
| H | H | L | L | L | L | L | L | H | H | L | L |
| H | H | L | H | L | L | L | L | H | H | L | L |
| H | H | H | L | L | L | L | L | L | L | H | H |
| H | H | H | H | L | L | L | L | L | L | H | H |

FIG.15

T1='H'

| D3 | D2 | D1 | D0 | X0 | X1 | X2 | X3 | X4 | X5 | X6 | X7 | X8 | X9 | X10 | X11 | X12 | X13 | X14 | X15 |
|---|---|---|---|---|---|---|---|---|---|---|---|---|---|---|---|---|---|---|---|
| L | L | L | L | H | H | H | H | L | L | L | L | L | L | L | L | L | L | L | L |
| L | L | L | H | H | H | H | H | L | L | L | L | L | L | L | L | L | L | L | L |
| L | L | H | L | H | H | H | H | L | L | L | L | L | L | L | L | L | L | L | L |
| L | L | H | H | H | H | H | H | L | L | L | L | L | L | L | L | L | L | L | L |
| L | H | L | L | L | L | L | L | H | H | H | H | L | L | L | L | L | L | L | L |
| L | H | L | H | L | L | L | L | H | H | H | H | L | L | L | L | L | L | L | L |
| L | H | H | L | L | L | L | L | H | H | H | H | L | L | L | L | L | L | L | L |
| L | H | H | H | L | L | L | L | H | H | H | H | L | L | L | L | L | L | L | L |
| H | L | L | L | L | L | L | L | L | L | L | L | H | H | H | H | L | L | L | L |
| H | L | L | H | L | L | L | L | L | L | L | L | H | H | H | H | L | L | L | L |
| H | L | H | L | L | L | L | L | L | L | L | L | H | H | H | H | L | L | L | L |
| H | L | H | H | L | L | L | L | L | L | L | L | H | H | H | H | L | L | L | L |
| H | H | L | L | L | L | L | L | L | L | L | L | L | L | L | L | H | H | H | H |
| H | H | L | H | L | L | L | L | L | L | L | L | L | L | L | L | H | H | H | H |
| H | H | H | L | L | L | L | L | L | L | L | L | L | L | L | L | H | H | H | H |
| H | H | H | H | L | L | L | L | L | L | L | L | L | L | L | L | H | H | H | H |

FIG.17

| T1 | D2 | D1 | D0 | X0a | X0b | X0 | X1 | X2 | X3 | X4 | X5 | X6 | X7 | X7a | X7b |
|---|---|---|---|---|---|---|---|---|---|---|---|---|---|---|---|
| L | L | L | L | L | L | H | L | L | L | L | L | L | L | L | L |
| L | L | L | H | L | L | L | H | L | L | L | L | L | L | L | L |
| L | L | H | L | L | L | L | L | H | L | L | L | L | L | L | L |
| L | L | H | H | L | L | L | L | L | H | L | L | L | L | L | L |
| L | H | L | L | L | L | L | L | L | L | H | L | L | L | L | L |
| L | H | L | H | L | L | L | L | L | L | L | H | L | L | L | L |
| L | H | H | L | L | L | L | L | L | L | L | L | H | L | L | L |
| L | H | H | H | L | L | L | L | L | L | L | L | L | H | L | L |
| H | L | L | L | H | H | H | L | L | L | L | L | L | L | L | L |
| H | L | L | H | L | L | H | H | H | L | L | L | L | L | L | L |
| H | L | H | L | L | L | L | H | H | H | L | L | L | L | L | L |
| H | L | H | H | L | L | L | L | H | H | H | L | L | L | L | L |
| H | H | L | L | L | L | L | L | L | H | H | H | L | L | L | L |
| H | H | L | H | L | L | L | L | L | L | H | H | H | L | L | L |
| H | H | H | L | L | L | L | L | L | L | L | H | H | H | L | L |
| H | H | H | H | L | L | L | L | L | L | L | L | L | H | H | H |

LIQUID-CRYSTAL DISPLAY APPARATUS INCORPORATING DRIVE CIRCUIT IN SINGLE INTEGRATED ASSEMBLY

FIELD OF THE INVENTION

The present invention relates to a drive circuit of a liquid-crystal display apparatus of the active-matrix system. More particularly, the present invention relates to a liquid-crystal display apparatus with a drive circuit thereof created on the same substrate as an active-matrix substrate of a display unit.

BACKGROUND OF THE INVENTION

A liquid-crystal display apparatus of the active-matrix system comprises a display unit and a drive circuit unit. The display unit comprises transistors created at cross points of a plurality of data lines and a plurality of scan lines which are perpendicular to the data lines. The drive circuit unit controls the voltages of the data lines and the scan lines. The transistors employed in the display unit can be a-Si TFTs (amorphous-Silicon thin-film transistors), p-Si (poly-Silicon) TFTs, single-crystal silicon MOS (metal-oxide semiconductor) transistors or transistors of another type. An a-Si TFT is created on a glass substrate with an externally attached single-crystal sillicon integrated circuit serving as a drive circuit thereof. A p-Si TFT can be a high-temperature p-Si TFT created on a quartz substrate or a low-temperature p-Si TFT created on a glass substrate. The drive circuits of a high-temperature p-Si TFT and a low-temperature p-Si TFT are created on the same substrate as the display unit along with the single-crystal silicon MOS transistors. In addition, an a-Si TFT and a low-temperature p-Si TFT created on a glass substrate can be implemented in a large size. On the other hand, a transistor using a quartz or single-crystal silicon substrate can be implemented only in a small size.

The configuration and the operation of a liquid-crystal display apparatus of such an active-matrix system are explained in more detail as follows.

The gate, the drain and the source of a transistor employed in the display unit are connected to a scan line, a data line and a display electrode respectively. A facing substrate having a transparent electrode on one of the surfaces thereof is provided to face the display electrode. A liquid-crystal is sandwiched by the display electrode and the facing substrate. Normally, a signal holding capacitor is connected to the display electrode. Thus, the signal holding capacitor and a liquid-crystal capacitor are connected to a source electrode in parallel. When a gate electrode is selected, the transistor including the gate electrode is put in a conductive state, allowing a picture signal on the data line to be written into the liquid-crystal capacitor and the signal holding capacitor. As the gate electrode is deselected, the transistor including the gate electrode is put in a high-impedance state in which the picture signal written into the signal holding capacitor is sustained.

The drive circuit unit comprises a vertical drive circuit for controlling the voltages of the scan lines and a horizontal drive circuit for controlling the voltages of the data lines. The vertical drive circuit applies a scanning pulse to each of the scan lines in a frame time. Normally, the timings of the pulses are shifted from each other as the scanning moves from the top of the panel to the bottom. Generally, a frame time is 1/60 seconds. In a panel having a representative pixel configuration of 1,024×768 dots, 768 scanning operations are carried out during a frame time so that the width of a scanning pulse is about 20 $\mu$s. The vertical drive circuit employs an ordinary shift resister with an operating speed corresponding to a frequency of about 50 kHz.

On the other hand, the horizontal drive circuit applies a liquid-crystal driving voltage corresponding to pixels on a line driven by a scanning pulse to each data line. In a pixel to which a scanning pulse is applied, the voltage of the gate electrode of the transistor connected to the scan line applying the scanning pulse increases, putting the transistor in a turned-on state. In this state, a liquid-crystal driving voltage on the data line is applied to the liquid-crystal through the drain and the source of the transistor, electrically charging a pixel capacitor which comprises the liquid-crystal capacitor and the signal holding capacitor connected in parallel. By repeating this operation, a voltage corresponding to a picture signal repeated for each frame time is applied to the liquid-crystal on the entire surface of the panel, electrically charging the pixel capacitors on the entire surface of the panel.

The horizontal drive circuit can be of an analog system or a digital system in dependence on the input picture signal. In the case of the analog system, the horizontal drive circuit for driving a data line comprises a shift register and a sample-and-hold circuit. The shift register determines timing of the sample-and-hold circuit for each pixel. With this timing, the sample-and-hold circuit samples a picture signal corresponding to each pixel and applies a liquid-crystal driving voltage to each data line. This driving method allows the shift register for determining timing and the sample-and-hold circuit for sampling a picture signal to be implemented by a simple circuit. Thus, this method is mainly adopted in a liquid-crystal display panel incorporating a drive circuit in a single integrated assembly.

In the case of the pixel configuration described above, the shift register employed in the horizontal drive circuit generates a timing signal 1,024 times in a period of time corresponding to the width of a scanning pulse output by the vertical drive circuit. Thus, the interval between 2 consecutive timings is shorter than 20 ns. That is to say, the shift register needs to operate at a speed corresponding to a frequency of at least 50 MH. Thus, the sample-and-hold circuit is required to sample a picture signal with timing corresponding to such a short interval. A liquid-crystal display panel incorporating a drive circuit in a single integrated assembly adopts a technique whereby a picture signal is divided into a plurality of input signals to increase the sampling interval. With a high-speed picture signal split into a plurality of sampled picture signals in this way, however, it is necessary to provide a signal conversion circuit for amplifying and the split signals and converting the signals into alternating-current signals.

In the case of the digital system, on the other hand, the horizontal drive circuit for driving a data line comprises a shift register, latch circuits at 2 stages and a digital-to-analog conversion circuit. A digital signal supplied sequentially to the horizontal drive circuit is stored in the latch circuits at the 2 stages through the shift register. On the other hand, the digital-to-analog conversion circuit converts the digital data into an analog voltage applied to each of the data lines as a liquid-crystal driving voltage.

The bit counts of the latch circuits and the digital-to-analog conversion circuit in this system are determined by a display tone. In the case of a full color display requiring 256 tones, the number of bits is 8. In the case of the pixel configuration described above, a 16384-bit (=8×2×1024 bits) latch circuit and 1,024 8 bit digital-to-analog conversion circuits are required. There is adopted a method for selecting a reference voltage by means of a switch in order to reduce the number of variations among digital-to-analog conversion circuits of the data lines. Since the picture signal is a digital signal in this digital system, it is possible to prevent the S/N ratio from deteriorating during transmission of the signal.

In addition, in the case of the digital system, there is provided a method whereby, after a digital picture signal is converted into an analog signal by a digital-to-analog conversion circuit operating at a high speed, a voltage to be applied to each of the data lines is generated by using the same technique as the analog system.

The method wherein a digital-to-analog conversion circuit is provided for each of the data lines is disclosed in documents such as Japanese Patent Laid-open No. Hei 9-26765. On the other hand, documents such as Japanese Patent Laid-open No. Hei 5-80722 or Hei 5-173506 disclose the method whereby, after a digital picture signal is converted into an analog signal by a digital-to-analog conversion circuit operating at a high speed, a voltage to be applied to each of the data lines is generated by using the same technique as the analog system.

SUMMARY OF THE INVENTION

The conventional horizontal drive circuit is implemented by an integrated circuit made of single-crystal Si and externally attached to an active-matrix substrate of the display unit. The integrated circuit is implemented into a plurality of smaller units which are each provided for about 300 data lines. In the case of a liquid-crystal display panel incorporating a drive circuit in a single integrated assembly, on the other hand, it is necessary to create a drive circuit of all data lines required for a display operation on the same substrate. In this example, the number of data lines is 1,024. In the case of a color display, the number of data lines is 3,072 which is 3×1,024. Thus, in the case of a color display in a liquid-crystal display panel incorporating a drive circuit in a single integrated assembly, the number of data lines is about 10 times the number of data lines driven by a unit of the conventional horizontal drive circuit. In addition, since the load capacitance of the data lines is proportional to the picture display size, reduction of the circuit scale including reduction of the device count and the occupied area without sacrificing the required performance is a big challenge in the application of the technology of the conventional circuit to a liquid-crystal display panel incorporating a drive circuit in a single integrated assembly.

The following description explains problems which are encountered in the horizontal drive circuit based on the conventional technology to a liquid-crystal display panel incorporating a drive circuit in a single integrated assembly and, hence, remain to be solved.

In the method wherein a digital-to-analog conversion circuit is provided in the horizontal drive circuit for a data line in accordance with the conventional technology described above, there is raised a problem of an enlarging circuit size accompanying a rising number of pixels and an increasing number of display tones. To be more specific, the size of the digital-to-analog conversion circuit is proportional to the number of pixels laid out in the horizontal direction and the size of a latch circuit employed in the digital-to-analog conversion circuit is proportional to the number of bits representing the display tones. The sizes of a decoder circuit and a voltage multiplexer circuit which are employed in the horizontal drive circuit are proportional to the square of the bit count. As a result, there is raised a problem of an increased cost of the device as a whole.

In addition, there is also encountered a problem of interference between a voltage output by a digital-to-analog conversion circuit provided for a data line and a voltage output by a digital-to-analog conversion circuit provided for another data line. This is because the reference voltage of a digital-to-analog conversion circuit changes in dependence on a current supplied to the digital-to-analog conversion circuit and the resistance of a bus line. The variations in reference voltage are proportional to the number of digital-to-analog conversion circuits in use and the length of the bus line. As a result, there is a problem of an inability to obtain a sufficiently high picture quality encountered in an attempt to raise the display resolution and increase the size of the screen.

The method whereby digital image data is converted by a digital-to-analog conversion circuit into an analog signal to be sampled has a problem of interference between a voltage output by a digital-to-analog conversion circuit provided for a data line and a voltage output by a digital-to-analog conversion circuit provided for another data line. In this system, the number of digital-to-analog conversion circuits is proportional to the number of pixels and it is necessary to implement a liquid-crystal display apparatus having a high resolution by using a plurality of digital-to-analog conversion circuits. As a result, there is a problem of an inability to obtain a sufficiently high picture quality encountered in an attempt to raise the display resolution and increase the size of the screen as is the case with the method wherein a digital-to-analog conversion circuit is provided for a data line.

It is thus an object of the present invention addressing the problems described above to provide a large-size liquid-crystal display apparatus incorporating a drive circuit in a single integrated assembly wherein variations in voltage generated in the single integrated assembly including the drive circuit are suppressed.

It is another object of the present invention to provide a large-size liquid-crystal display apparatus incorporating a drive circuit in a single integrated assembly wherein the area occupied by the single integrated assembly including the large-size liquid-crystal display apparatus and the drive circuit is reduced.

A liquid-crystal display apparatus implemented by a first aspect of the present invention comprises a first substrate, a second substrate and a liquid-crystal sandwiched by the first and the second substrates, wherein a switching element is created at a cross point of a scan line and a data line on the first substrate, a vertical drive circuit for controlling a voltage of the scan line is created on the first substrate, a horizontal drive circuit for controlling a voltage of the data line is created on the first substrate, a transparent electrode is created on one of the surfaces of the second substrate, the horizontal drive circuit comprises a plurality of digital-to-analog conversion means each for receiving a reference voltage and digital image data and converting the digital image data into an analog voltage and a sample-and-hold means for sampling a plurality of analog voltages output by the digital-to-analog conversion means with predetermined timing and he reference voltage is supplied from each of a plurality of terminals associated with the digital-to-analog conversion means.

According to a second aspect of the present invention, in a liquid-crystal display apparatus, the horizontal drive circuit comprises a plurality of digital-to-analog conversion means each for receiving a reference voltage and digital image data and converting the digital image data into an analog voltage and a sample-and-hold means for sampling a plurality of analog voltages output by the digital-to-analog conversion means with predetermined timing and the digital-to-analog conversion means are configured into a plurality of digital-to-analog-conversion-means pairs each comprising a positive-polarity digital-to-analog conversion means for generating a positive-polarity analog voltage and a negative-polarity digital-to-analog conversion means for generating a negative-polarity analog voltage.

A liquid-crystal display apparatus implemented by a third aspect of the present invention comprises a first substrate, a second substrate and a liquid-crystal sandwiched by the first and the second substrates, wherein a switching element is created at a cross point of a scan line and a data line on the first substrate, a vertical drive circuit for controlling a voltage of the scan line is created on the first substrate, a horizontal drive circuit for controlling a voltage of the data line is created on the first substrate, a transparent electrode is created on one of the surfaces of the second substrate, the horizontal drive circuit comprises a reference-voltage generation means for generating a plurality of voltages, a voltage select means including a plurality of voltage select switches for selecting a specific voltage corresponding to image data among the voltages generated by the reference-voltage generation means, a control means for controlling the voltage select means in accordance with the image data supplied thereto and a sample-and-hold means for sampling the specific voltage output by the voltage select means with predetermined timing and the control means has a first state for charging the data line by turning on at least a plurality of the voltage select switches and a second state for turning on a smaller number of the voltage select switches than the voltage select switches turned on in the first state.

According to a fourth aspect of the present invention, in a liquid-crystal display apparatus, the voltage select switches are organized into N voltage-select-switch sets each comprising M voltage select switches where M and N are each an integer at least equal to 2 and the voltage select switches turned on in the first state include the voltage select switches turned on in the second state.

According to a fifth aspect of the present invention, in a liquid-crystal display apparatus, the control circuit includes a decoder for receiving j-bit image data and the logically inverted data of the image data and decoding the j bits into one of k possible outputs where k is the jth power of 2 and logical sums of low-order n bits of the image data where $1 \leqq n < j$ and a control signal T1 as well as logical sums of the logically inverted data of the low-order n bits of the image data and the control signal T1 are supplied to the decoder.

According to a sixth aspect of the present invention, in a liquid-crystal display apparatus, the control circuit includes a decoder for decoding j-bit image data into one of k possible outputs where k is jth power of 2, 2-input logical-product circuits and 3-input logical-sum circuits, inputs to each of the 2-input logical-product circuits are one of the outputs of the decoder and the control signal T1, and inputs to each of the 3-input logical-sum circuits are one of the outputs of the decoder and outputs of 2 adjacent ones of the 2-input logical-product circuits.

BRIEF DESCRIPTION OF THE DRAWINGS

FIG. 15 shows a truth table used in a decoder employed in the digital-to-analog conversion circuit of FIG. 14 provided by the present invention;

FIG. 17 shows a truth table used in a decoder employed in the digital-to-analog conversion circuit of FIG. 16 provided by the present invention.

DETAILED DESCRIPTION OF THE INVENTION

The present invention will become more apparent from a careful study of the following detailed description of some preferred embodiments of the present invention with reference to the accompanying diagrams.

Figure 1:
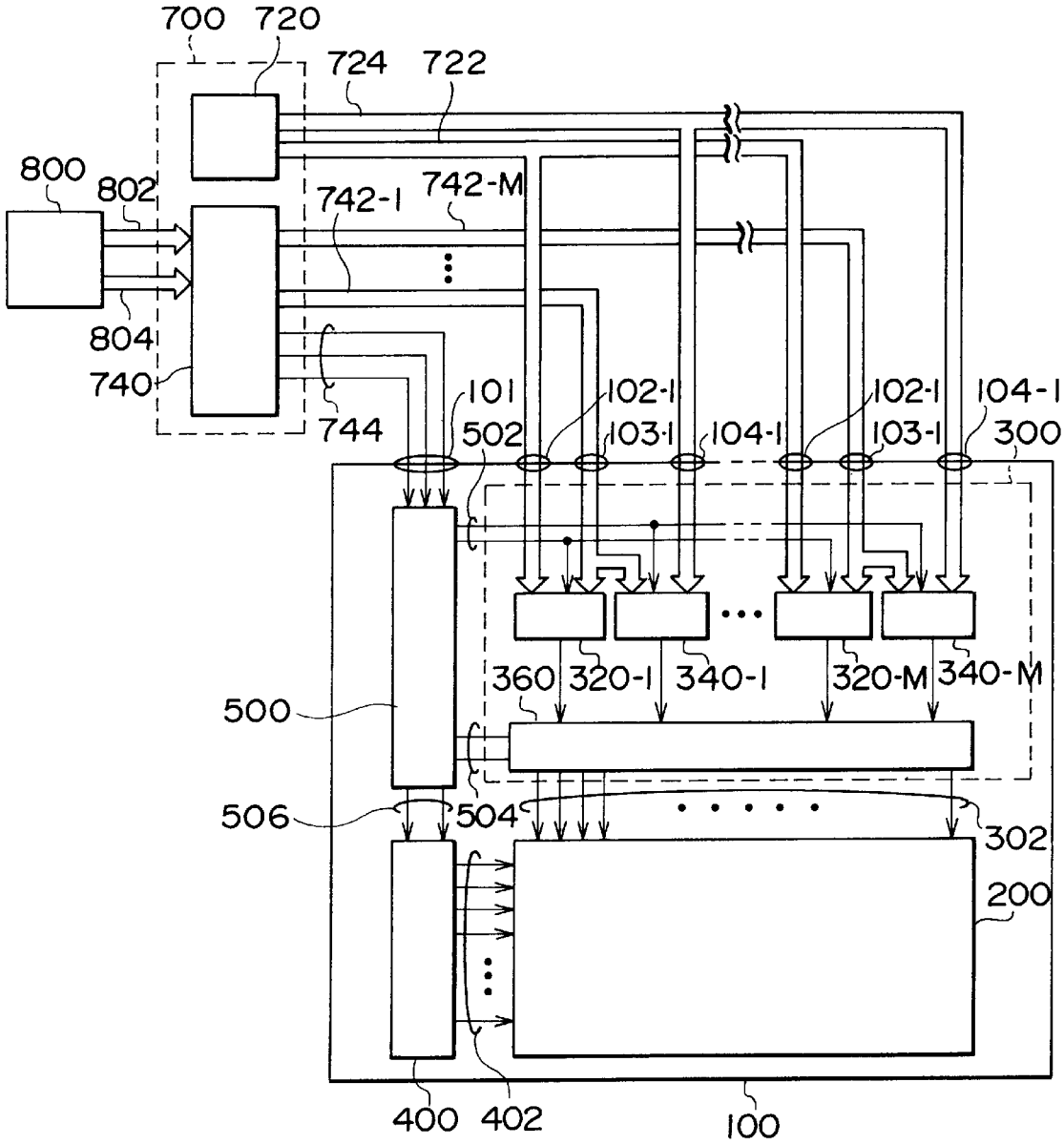
FIG. 1 is a block diagram showing the configuration of a first embodiment implementing a liquid-crystal display apparatus incorporating a drive circuit in a single integrated assembly.

FIG. 1 is a block diagram showing the configuration of a first embodiment implementing a liquid-crystal display apparatus incorporating a drive circuit in a single integrated assembly. The embodiment has a configuration inputting M pieces of image data in parallel where M is an integer. As shown in the figure, the embodiment comprises a liquid-crystal display panel 100 incorporating a drive circuit in a single integrated assembly, an interface circuit 700 and a picture signal source 800. The liquid-crystal display panel 100 incorporating a drive circuit in a single integrated assembly comprises a display unit 200, a horizontal drive circuit 300, a vertical drive circuit 400, a control circuit 500 and terminals 101, 102-1 to 102-M, 103-1 to 103-M and 104-1 to 104-M. The terminals comprise a plurality of input pads.

The horizontal drive circuit 300 comprises positive-polarity digital-to-analog conversion circuits 320-1 to 320-M, negative-polarity digital-to-analog conversion circuits 340-1 to 340-M and a voltage multiplexer 360. The interface circuit 700 comprises a reference-voltage generation circuit 720 and a serial-to-parallel signal conversion circuit 740.

The picture-signal source 800 outputs digital image data 802 and a control signal 804 to the serial-to-parallel signal conversion circuit 740. The control signal 804 includes a horizontal-synchronization signal Hs, a vertical-synchronization signal Vs and a clock signal CK1 which are not shown in the figure. The serial-to-parallel signal conversion circuit 740 converts the digital image data 802 received serially from the picture-signal source 800 into a plurality of parallel signals or pieces of image data denoted by reference numerals 742-1 to 742-M. The serial-to-parallel signal conversion circuit 740 also generates a control signal 744 supplied to the control circuit 500. The control signal 744 includes a clock signal CK2 for the pieces of image data 742-1 to 742-M, the horizontal-synchronization signal Hs, the vertical-synchronization signal Vs and an alternating-current conversion control signal FLP which are not shown in the figure. The reference-voltage generation circuit 720 generates a negative-polarity reference voltage 722 and a positive-polarity reference voltage 724 supplied to the negative-polarity digital-to-analog conversion circuits 340-1 to 340-M and the positive-polarity digital-to-analog conversion circuits 320-1 to 320-M respectively.

The control circuit 500 inputs the control signal 744 through the terminal 101, outputting a 2-phase signal 502 specifying data fetch timing of the positive-polarity digital-to-analog conversion circuits 320-1 to 320-M and the negative-polarity digital-to-analog conversion circuits 340-1 to 340-M, a control signal 504 to the voltage multiplexer 360 and a control signal 506 to the vertical drive circuit 400. The horizontal drive circuit 300 inputs the pieces of image data 742-1 to 742-M and the negative-polarity and positive-polarity reference voltages 722 and 724, converting the pieces of image data 742-1 to 742-M into analog signals supplied to the voltage multiplexer 360. The voltage multiplexer 360 receives the analog signals and the control signal 504, applying a voltage to each of data lines 302 of the display unit 200. The vertical drive circuit 400 inputs the control signal 506, outputting a scanning signal to each of scan lines 402 of the display unit 200. The display unit 200 displays a picture based on signals appearing on the data lines 302 and the scan lines 402.

In the liquid-crystal display apparatus implemented by the embodiment of the present invention, the voltage of a data line 302 is set as a result of electrically charging a parasitic capacitor added to the data line 302 by an output of the reference-voltage generation circuit 720. A current of the electrical charging flows between the reference-voltage generation circuit 720 and the positive-polarity and negative-polarity digital-to-analog conversion circuits 320-1 to 320-M and 340-1 to 340-M. A product of the electrical-charging current and a line resistance between the reference-voltage generation circuit 720 and the positive-polarity and negative-polarity digital-to-analog conversion circuits 320-1 to 320-M and 340-1 to 340M appears as a difference in voltage between the reference-voltage generation circuit 720 and the positive-polarity and negative-polarity digital-to-analog conversion circuits 320-1 to 320-M and 340-1 to 340-M. In addition, at a line portion where currents generated by the positive-polarity and negative-polarity digital-to-analog conversion circuits 320-1 to 320-M and 340-1 to 340-M merge, interference among the positive-polarity and negative-polarity digital-to-analog conversion circuits 320-1 to 320-M and 340-1 to 340M occurs.

In the embodiment of the present invention, a positive-polarity reference voltage 722 is supplied to the positive-polarity digital-to-analog conversion circuits 320-1 to 320-M through the terminals 102-1 to 102-M respectively and a negative-polarity reference voltage 724 is supplied to the negative-polarity digital-to-analog conversion circuits 340-1 to 340-M through the terminals 104-1 to 104-M respectively. In addition, the line portion where currents generated by the positive-polarity and negative-polarity digital-to-analog conversion circuits 320-1 to 320-M and 340-1 to 340-M merge is brought to the outside of the liquid-crystal display panel 100 incorporating a drive circuit in a single integrated assembly so that the portion can be made of a material having a low resistance.

As described above, the embodiment of the present invention allows variations among the digital-to-analog conversion circuits to be reduced to give an effect of implementability of a liquid-crystal display apparatus capable of producing a good picture quality.

Figure 2:
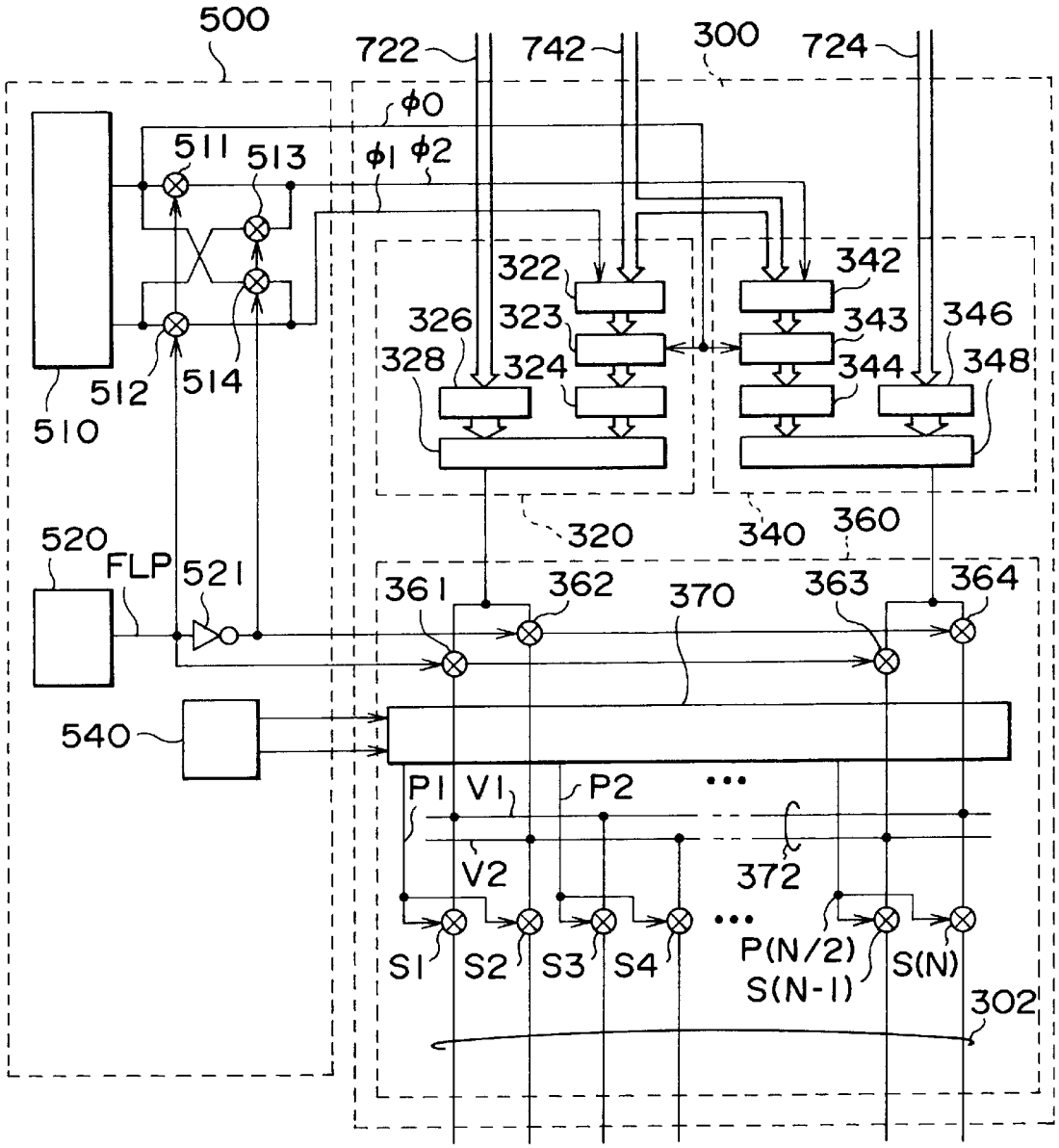
FIG. 2 is a circuit diagram showing the configuration of a first embodiment implementing a horizontal drive circuit employed in the drive circuit of the first embodiment implementing a liquid-crystal display apparatus incorporating the drive circuit in a single integrated assembly.

An embodiment implementing the horizontal drive circuit provided by the present invention is described in more detail as follows. FIG. 2 is a circuit diagram showing the configuration of a horizontal drive circuit employed in the first embodiment implementing a liquid-crystal display apparatus incorporating a drive circuit in a single integrated assembly. As shown in the figure, the embodiment is exemplified by 2 digital-to-analog conversion circuits 320 and 340.

The horizontal drive circuit 300 comprises the positive-polarity digital-to-analog conversion circuit 320, the negative-polarity digital-to-analog conversion circuit 340 and the voltage multiplexer 360. The positive-polarity digital-to-analog conversion circuit 320 comprises latch circuits 322 and 323, a decoder circuit 324, a reference-voltage conversion circuit 326 and a voltage select circuit 328. Similarly, the negative-polarity digital-to-analog conversion circuit 340 comprises latch circuits 342 and 343, a decoder circuit 344, a reference-voltage conversion circuit 346 and a voltage select circuit 348. The voltage multiplexer 360 comprises switches 361 to 364, sampling switches S1 to SN, a shift register 370 and video data lines 372. The control circuit 500 comprises a 2-phase signal generation circuit 510, change-over switches 511 to 514, a polarity control circuit 520, an inverter 521 and a shift-register control circuit 540.

The horizontal drive circuit 300 employed in the liquid-crystal display apparatus incorporating a drive circuit in a single integrated assembly is explained by referring to a timing diagram shown in FIG. 3 as follows.

Figure 3:
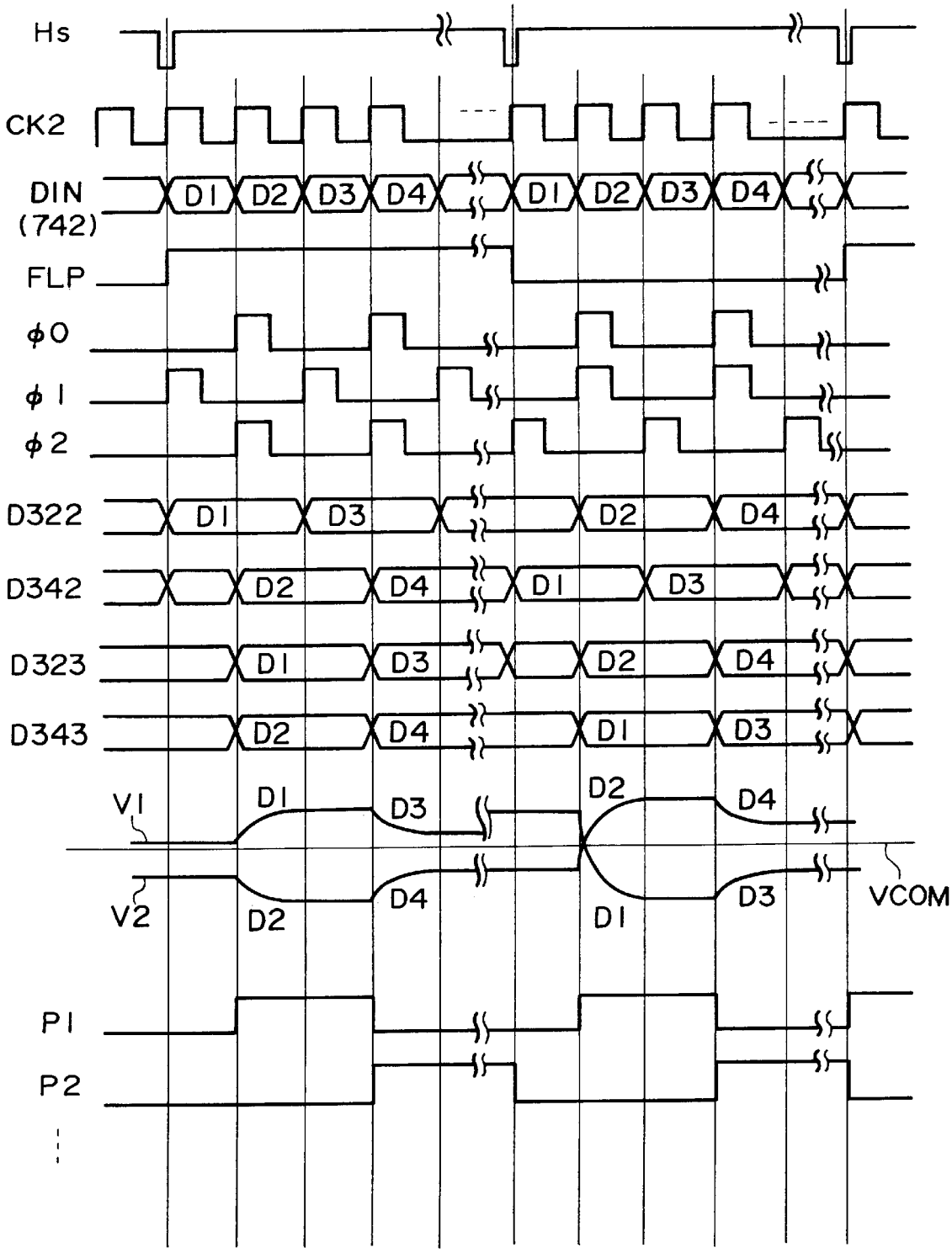
FIG. 3 is a timing diagram showing the operation of the first embodiment implementing a liquid-crystal display apparatus incorporating a drive circuit in a single integrated assembly.

The horizontal synchronization signal Hs and the clock signal CK2 shown in FIG. 3 are internal signals of the control circuit 500. Pieces of digital image data DIN 742, that is, D1, D2, D3 and so on, are supplied sequentially one piece after another in synchronization with the clock signal CK2 with the first piece D1 supplied with timing indicated by the horizontal synchronization signal Hs.

A polarity control signal FLP is output by the polarity control circuit 520. The polarity of the polarity control signal is inverted by the appearance of each pulse of the horizontal synchronization signal Hs. Latch control signals $\phi$0, $\phi$1 and $\phi$2 are output by the 2-phase signal generation circuit 510 through the change-over switches 511 to 514. To put it in detail, the latch control signals $\phi$1 and $\phi$2 are output as a result of controlling the change-over switches 511 to 514 by using the polarity control signal FLP. With the horizontal synchronization signal Hs taken as a reference, the phase of the latch control signal $\phi$1 leads ahead of the phase of the control signal $\phi$2 when the polarization control signal FLP is set at an "H" level, and lags behind the phase of the control signal $\phi$2 when the polarization control signal FLP is set at an "L" level. The latch control signal $\phi$0 is output at the same phase as either the latch control signal $\phi$1 or the latch control signal $\phi$2 which has a lagging phase.

Controlled by the latch control signals $\phi$1 and $\phi$2 respectively, the latch circuits 322 and 342 input pieces of digital image data 742. To be more specific, the latch circuit 322 inputs an odd-numbered piece of digital image data 742 when the polarity control signal is set at the "H" level, and an even-numbered piece of digital image data 742 when the polarity control signal is set at the "L" level. On the other hand, the latch circuit 342 inputs an even-numbered piece of digital image data 742 when the polarity control signal FLP is set at the "H" level, and an odd-numbered piece of digital image data 742 when the polarity control signal FLP is set at the "L" level.

The latch circuits 323 and 343 receive outputs of the latch circuits 322 and 342 respectively. Controlled by the latch control signal $\phi$0, pieces of data stored in the latch circuits 323 and 343 are both output with timing determined by the latch control signal $\phi$0.

The decoder circuits 324 and 344 receive outputs of the latch circuits 323 and 343 respectively, outputting decoded signals to the voltage select circuits 328 and 348 respectively. The decoder circuits 324 and 344 each have an n-bit digital signal input and K decoded-signal outputs where K is the nth power of 2. The decoder circuits 324 and 344 each activate one of their K decoded-signal outputs in dependence of the value of the n-bit digital signal input.

The reference-voltage conversion circuit 326 inputs the positive-polarity reference voltage 722, outputting K reference voltages to the voltage select circuit 328 where K is the nth power of 2. Similarly, the reference-voltage conversion circuit 346 inputs the negative-polarity reference voltage 724, outputting K reference voltages to the voltage select circuit 348.

The voltage select circuit 328 receives K decoded signals output by the decoder circuit 324 and K reference voltages output by the reference-voltage conversion circuit 326 where K is the nth power of 2, selecting one of the K reference voltages generated by the reference-voltage conversion circuit 326 in dependence on the decoded-signal output activated by the decoder circuit 324. Similarly, the voltage select circuit 348 receives K decoded signals output by the decoder circuit 344 and K reference voltages output by the reference-voltage conversion circuit 346, selecting one of the K reference voltages generated by the reference-voltage conversion circuit 346 in dependence on the decoded-signal output activated by the decoder circuit 344.

By carrying out the operations described above, the positive-polarity digital-to-analog conversion circuit 320 and the negative-polarity digital-to-analog conversion circuit 340 convert the digital image data 742 into analog voltages, outputting the analog voltages to the voltage multiplexer 360.

The switches 361 and 363 employed in the voltage multiplexer 360 are controlled by the polarity control signal FLP. To be more specific, when the polarity control signal FLP is set at the "H" level, the analog signals generated by the positive-polarity digital-to-analog conversion circuit 320 and the negative-polarity digital-to-analog conversion circuit 340 are output to V1 and V2 of the video data line 372 respectively. Similarly, the switches 362 and 364 employed in the voltage multiplexer 360 are also controlled by the polarity control signal FLP as well. To be more specific, when the polarity control signal FLP is set at the "L" level, the analog signals generated by the positive-polarity digital-to-analog conversion circuit 320 and the negative-polarity digital-to-analog conversion circuit 340 are output to V2 and V1 of the video data line 372 respectively. As a result, V1 of the video data line 372 represents a positive-polarity analog voltage signal which results from conversion of odd-numbered pieces of image data 742 when the polarity control signal FLP is set at the "H" level as shown in FIG. 3. On the other hand, V1 of the video data line 372 represents a negative-polarity analog voltage signal which results from conversion of odd-numbered pieces of image data 742 when the polarity control signal FLP is set at the "L" level as shown in FIG. 3. Similarly, V2 of the video data line 372 represents a negative-polarity analog voltage signal which results from conversion of even-numbered pieces of image data 742 when the polarity control signal FLP is set at the "H" level as shown in FIG. 3. On the other hand, V2 of the video data line 372 represents a positive-polarity analog voltage signal which results from conversion of even-numbered pieces of image data 742 when the polarity control signal FLP is set at the "L" level as shown in FIG. 3.

Odd-numbered switches of the sampling switches S1, S2, - - - S(N) are connected to V1 of the video data line 372. On the other hand, even-numbered switches of the sampling switches S1, S2, - - - S(N) are connected to V2 of the video data line 372. N data lines 302 of the display unit 200 are controlled by the sampling switches S1, S2, - - - S(N).

The shift register 370 is controlled by the shift-register control circuit 540, outputting signals P1, P2, - - - P(N/2) which have different phases and vary with timing determined by the latch control signal $\phi$0. The signals P1, P2, - - - P(N/2) having different phases each control 2 of the sampling switches S1, S2, - - - S(N). The analog voltages obtained as a result of conversion of the digital image data 742 by the digital-to-analog conversion circuits 320 and 340 are output sequentially to the data lines 302.

By carrying out the operation described above, the horizontal drive circuit 300 employed in the assembly provided by the present invention is capable of converting digital image data into analog voltages and controlling the data lines.

Figure 4:
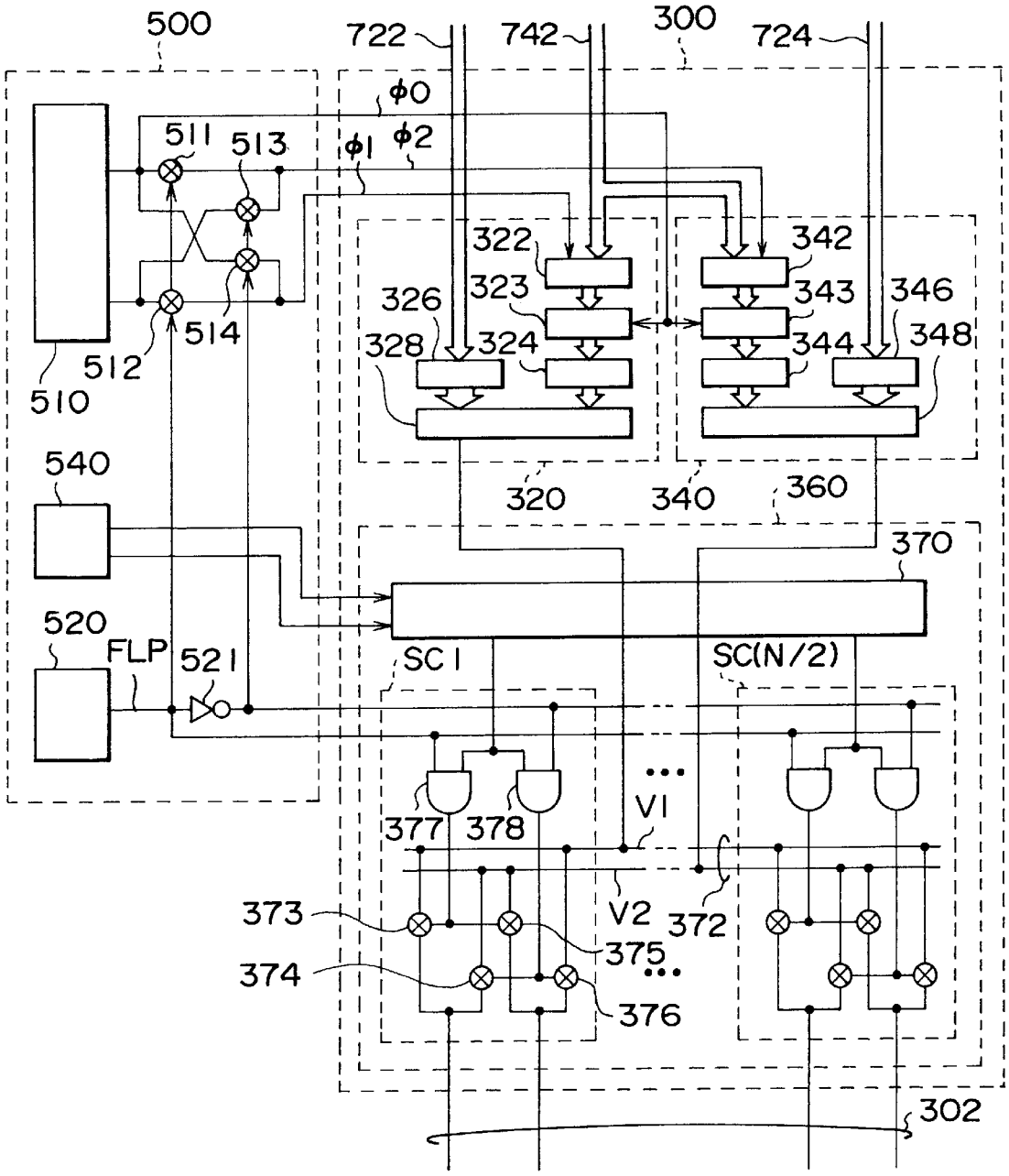
FIG. 4 is a circuit diagram showing the configuration of a second embodiment implementing a horizontal drive circuit implementing a liquid-crystal display apparatus incorporating the drive circuit in a single integrated assembly.

FIG. 4 is a circuit diagram showing the configuration of a second embodiment implementing the horizontal drive circuit employed in the liquid-crystal display apparatus incorporating a drive circuit in a single integrated assembly.

A difference between the second embodiment and the horizontal drive circuit shown in FIG. 2 lies in the configuration of the voltage multiplexer 360. To be more specific, the voltage multiplexer 360 employed in the second embodiment comprises a shift register 370, N/2 switch control circuits SC1, SC2, - - - SC(N/2) and a video data line 372. The switch control circuits SC1, SC2, - - - SC(N/2) each comprise AND circuits 377 and 378 and sampling switches 373 to 376. The AND control circuit 377 inputs the signals P1, P2, - - - , P(N/2) with different phases of the shift register 370 and the polarity control signal FLP, controlling the sampling switches 373 and 375. On the other hand, the AND control circuit 378 inputs the signals P1, P2, - - - , P(N/2) with different phases of the shift register 370 and the inverted signal of the polarity control signal FLP, controlling the sampling switches 374 and 376.

The sampling switches 373 and 374 are connected to V1 and V2 of the video data line 372 respectively and used for controlling the data lines 302 each having an odd number. On the other hand, the sampling switches 375 and 376 are connected to V1 and V2 of the video data line 372 respectively and used for controlling the data lines 302 each having an even number. V1 and V2 of the video data line 372 are controlled directly by analog voltages output by the positive-polarity and negative-polarity digital-to-analog conversion circuits 320 and 340 respectively.

In the configuration described above, a positive-polarity voltage is applied to V1 of the video data line 372 and a negative-polarity voltage is applied to V2 thereof. By switching these voltages using the sampling switches 373 and 374 or 375 and 376, the data lines 302 are driven. According to this configuration, switches between the output of the digital-to-analog conversion circuit 320 or 340 and the data lines 302 can be provided at 1 stage. Thus, the precision of the electrical charging of the data lines 302 can be increased. As a result, there is exhibited an effect of an ability to display a picture with a high quality.

In addition, the sampling switches 373 and 375 connected to V1 of the video data line 372 and used for controlling the voltage output by the positive-polarity digital-to-analog conversion circuit 320 are each implemented by a P-type TFT. On the other hand, the sampling switches 374 and 376 connected to V2 of the video data line 372 and used for controlling the voltage output by the negative-polarity digital-to-analog conversion circuit 340 are each implemented by an N-type TFT. As a result, the circuit size can be reduced.

Figure 5:
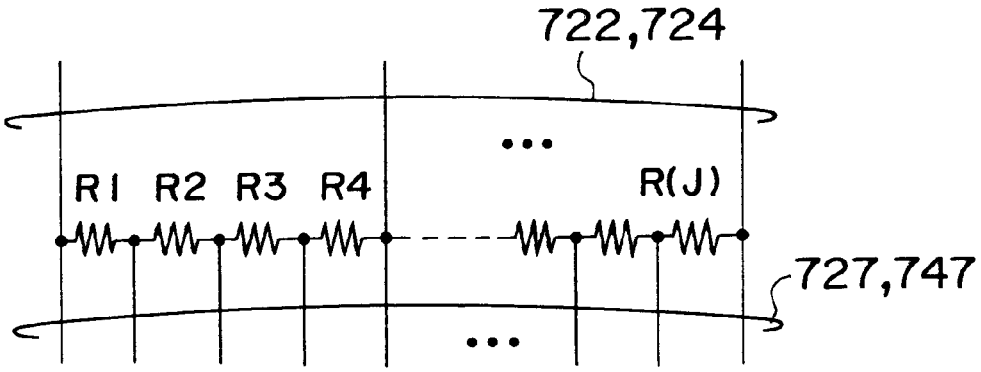
FIG. 5 is a circuit diagram showing the configuration of an embodiment implementing a reference-voltage conversion circuit employed in the liquid-crystal display apparatus incorporating a drive circuit in a single integrated assembly.

FIG. 5 is a circuit diagram showing the configuration of an embodiment implementing the reference-voltage conversion circuit 326 or 346 employed in the liquid-crystal display apparatus incorporating a drive circuit in a single integrated assembly. As shown in the figure, the reference-voltage conversion circuit 326 or 346 comprises string of resistors R1, - - - , R(J). The reference voltage 722 or 724 is supplied to the reference-voltage conversion circuit 326 or 346 respectively as an input voltage, being divided by the string resistors R1, - - -, R(J) to produce K reference voltages 727 or 747 respectively where K is the nth power of 2.

Figure 6:
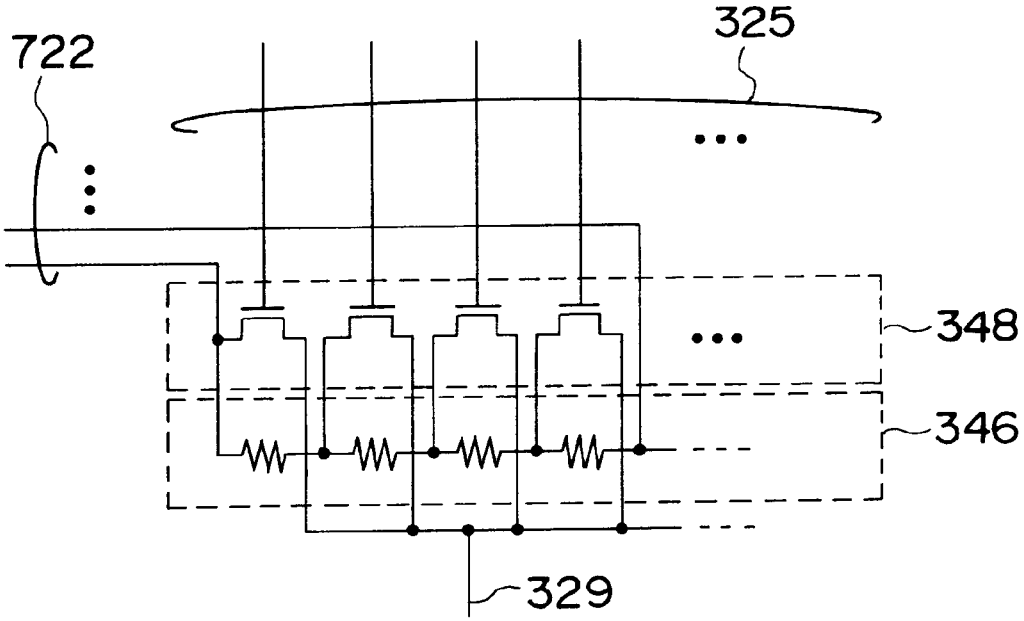
FIG. 6 is a circuit diagram showing the configuration of another embodiment implementing a reference-voltage conversion circuit employed in the liquid-crystal display apparatus incorporating a drive circuit in a single integrated assembly.

FIG. 6 is a circuit diagram showing the configuration of another embodiment implementing the reference-voltage conversion circuit 346 employed in the liquid-crystal display apparatus incorporating a drive circuit in a single integrated assembly. The figure shows the circuit configuration of an embodiment suitable for the negative-polarity digital-to-analog conversion circuit 340. The voltage select circuit 348 of this embodiment comprises N-type TFTs. The gate electrode and the drain electrode of each of the N-type TFTs are connected to a signal 325 output by the decoder circuit 344 and a signal 727 output by the reference-voltage conversion circuit respectively. The source electrodes of the N-type TFTs are connected to each other, outputting a voltage 329.

Figure 7:
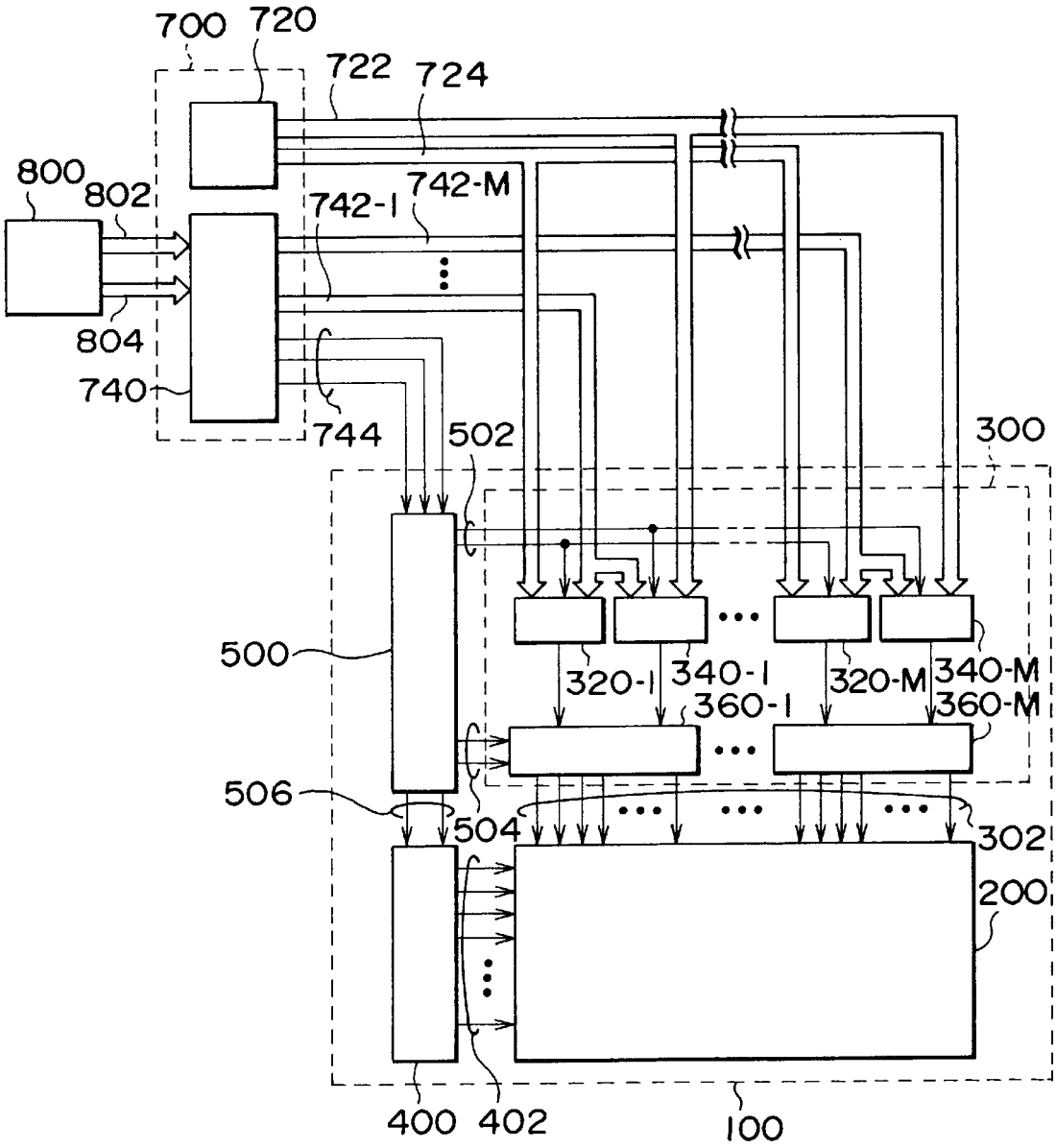
FIG. 7 is a block diagram showing the configuration of a second embodiment implementing a liquid-crystal display apparatus incorporating a drive circuit in a single integrated assembly.

FIG. 7 is a block diagram showing the configuration of a second embodiment implementing a liquid-crystal display apparatus incorporating a drive circuit in a single integrated assembly. The second embodiment is different from the first embodiment shown in FIG. 1 in that the voltage multiplexer 360 is divided into M units, namely, voltage multiplexer circuits 360-1 to 361-M as the positive-polarity digital-to-analog conversion circuit 320 is divided into positive-polarity digital-to-analog conversion circuits 320-1 to 320-M and the negative-polarity digital-to-analog conversion circuit 340 is divided into negative-polarity digital-to-analog conversion circuits 340-1 to 340-M. By such division, the number of video data lines 372 and their length can be reduced. Thus, the area occupied by the video data lines 372 can also be reduced as well. In addition, the electrical-charging time of the video data lines 372 which is determined by the wiring resistance of the video data lines 372 can also be shortened. As a result, the circuit size can be reduced and a picture with a high quality can be displayed.

As an alternative way of division, the horizontal drive circuit 300 may comprise a plurality of blocks which each include a plurality of pairs of digital-to-analog conversion circuits and a voltage multiplexer circuit. Each pair of digital-to-analog conversion circuits comprises a positive-polarity digital-to-analog conversion circuit and a negative-polarity digital-to-analog conversion circuit. As another alternative, in the case of a color liquid-crystal display apparatus, a pair of a positive-polarity digital-to-analog conversion circuit and a negative-polarity digital-to-analog conversion circuit is provided for each color. Thus, a set of 6 digital-to-analog conversion circuits are provided for the red, green and blue primary colors. In this case, the horizontal drive circuit 300 comprises a plurality of blocks which each include a plurality of such sets of digital-to-analog conversion circuits and a voltage multiplexer circuit.

In the liquid-crystal display apparatus incorporating a drive circuit in a single integrated assembly provided by the present invention, variations in reference voltage supplied to digital-to-analog conversion circuits can be suppressed. Thus, there is exhibited an effect of an ability to produce a sufficiently good picture quality even in the case of a high-resolution and large-screen liquid-crystal display apparatus.

Another embodiment of the present invention is described as follows.

Figure 9:
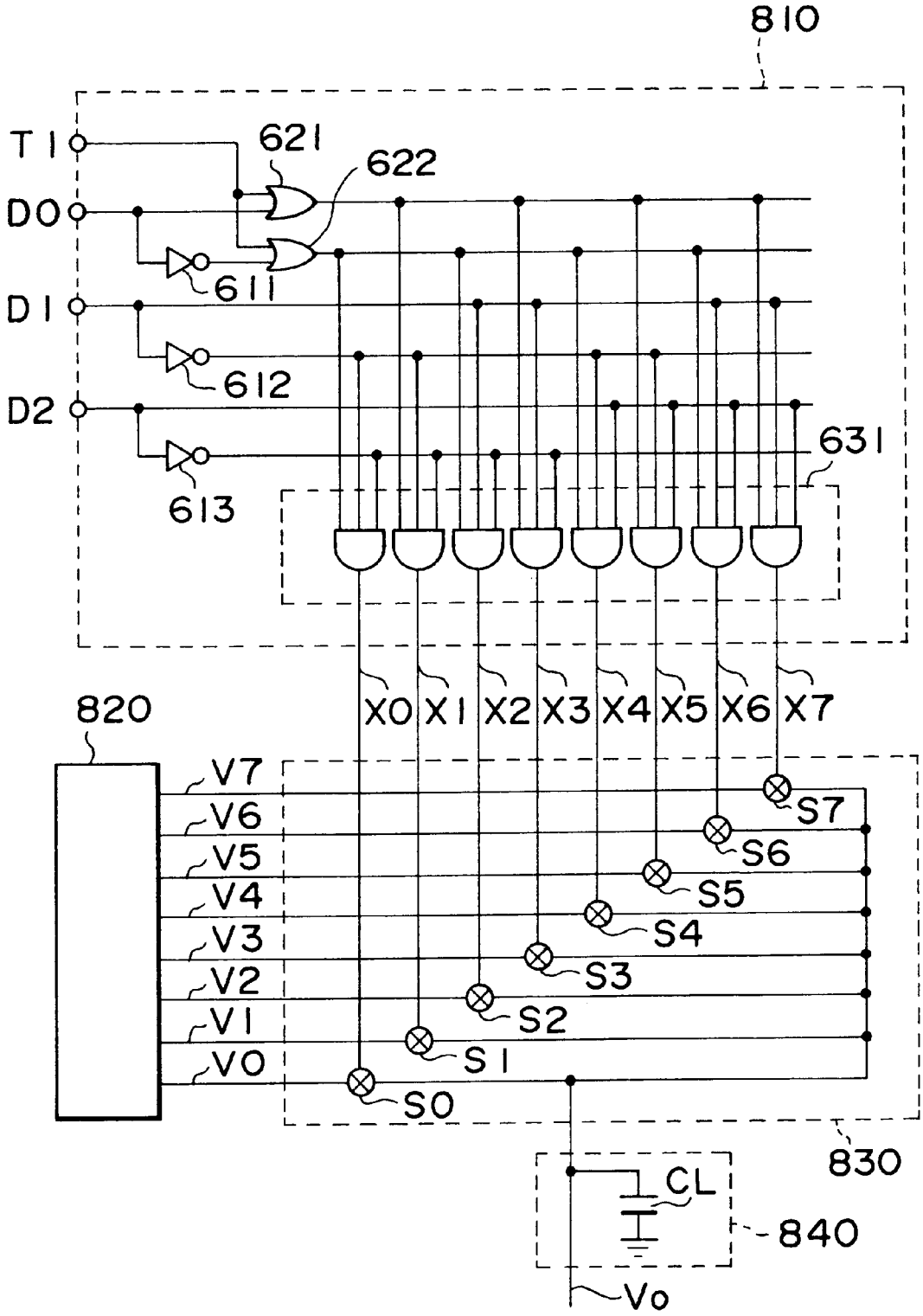
FIG. 9 is a block diagram showing the configuration of a third embodiment implementing a digital-to-analog conversion circuit provided by the present invention.

FIG. 9 is a block diagram showing the configuration of a third embodiment implementing a digital-to-analog conversion circuit provided by the present invention. As shown in the figure, the embodiment comprises a decoder 810, a reference-voltage generation circuit 820, a voltage select circuit 830 and a load circuit 840. The decoder 810 inputs 3 image-data bits D0 to D2 and a control signal T1, outputting 8 (the 3rd power of 2) switch control signals X0 to X7 to 8 select switches S0 to S7 of the voltage select circuit 830 respectively. The reference-voltage generation circuit 820 outputs 8 reference voltages V0 to V7 to the select switches S0 to S7 of the voltage select circuit 830 respectively. The select switches S0 to S7 are controlled by the switch control signals X0 to X7 respectively to select one of the reference voltages V0 to V7 as a voltage Vo. The load circuit 840 is represented by an equivalent capacitor CL connected to the output of the voltage select circuit 830.

The decoder 810 comprises inverters 611, 612 and 613, OR gates 621 and 622 and a plurality of AND gates 631. The inverters 611, 612 and 613 invert the input image-data bits D0, D1 and D3 respectively. The OR gate 621 inputs the control signal T1 and the image data D0. On the other hand, the OR gate 622 inputs the control signal T1 and the inverted signal of the image data D0. Each of the AND gates 631 inputs 3 signals selected among the pieces of data D1 and D2, the inverted signals of the pieces of data D1 and D2 and signals output by the OR gates 621 and 622. Thus, the data D0 and its inverted signal are supplied to the AND gates 631 through the OR gates 621 and 622 respectively.

Figures 10, 11A, 11B:
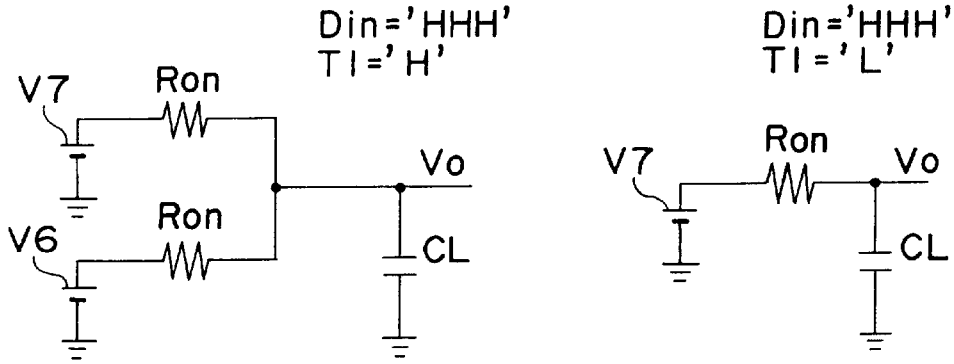
FIG. 10 shows a truth table used in a decoder employed in the digital-to-analog conversion circuit of FIG. 9 provided by the present invention.
FIGS. 11A and 11B are diagrams each showing an equivalent circuit representing a state of a select switch employed in the digital-to-analog conversion circuit provided by the present invention.

FIG. 10 shows a truth table showing relations of the control signal T1 and the 3 image-data bits D0 to D2 versus the switch control signals X0 to X7 of the decoder 810 described above. As shown in the upper portion of the table, with the control signal T1 set at the "L" level, the 3 image-data bits D0 to D2 set one of the 8 switch control signals X0 to X7 to a "H" level. As shown in the lower portion of the table, with the control signal T1 set at the "H" level, on the other hand, the 3 image-data bits D0 to D2 set 2 adjacent ones of the switch control signals X0 to X7 to a "H" level.

FIGS. 11A and 11B are diagrams showing equivalent circuits representing the states with the control signal T1 set at the "H" and "L" levels. The 3 image-data bits D0 to D2 set at the "H" level. The symbol Ron is the resistance of the select switch Sj put in a conductive state by the switch control signal Xj set at the "H" level where j=0 to 7. The diagram on the left-hand side shows an equivalent circuit representing the select switches S6 and S7 both put in the conductive state by the control signal T1 set at the "H" level. On the other hand, the diagram on the right-hand side shows an equivalent circuit representing only the select switch S7 put in the conductive state by the control signal T1 set at the "L" level.

Figure 12:
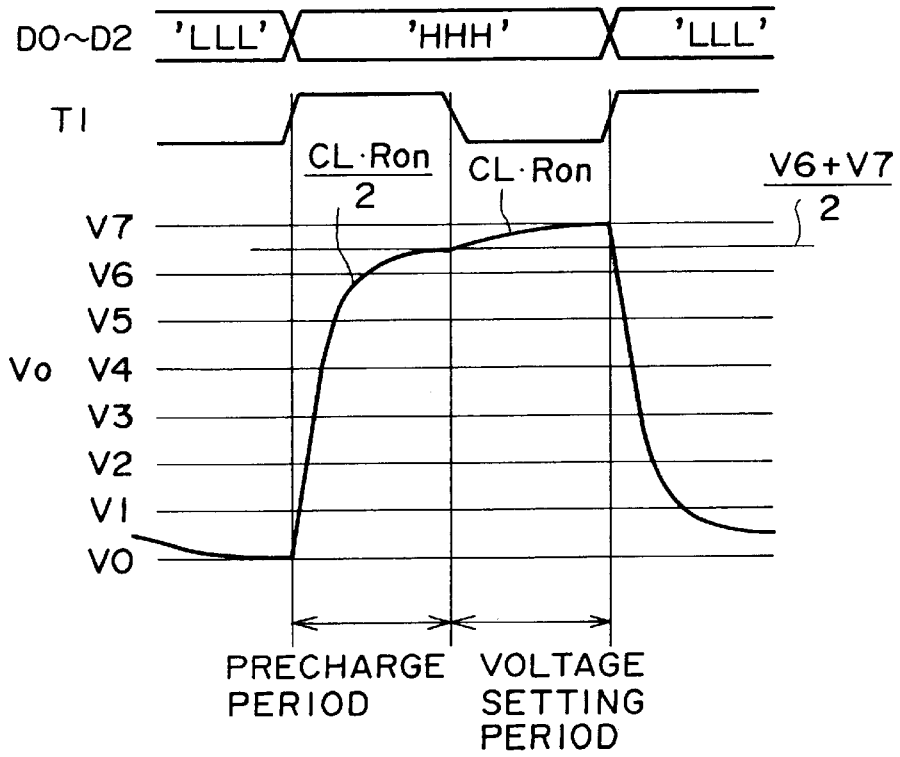
FIG. 12 is a diagram showing the operation of the select switch employed in the digital-to-analog conversion circuit provided by the present invention.

FIG. 12 is a diagram showing the operation of the select switch Sj employed in the digital-to-analog conversion circuit provided by the present invention.

The digital-to-analog conversion period of the digital-to-analog conversion circuit is split into a precharge period and a voltage setting period. During the precharge period, the control signal T1 is set at the "H" level. During the voltage setting period, on the other hand, the control signal T1 is set at the "L" level. As a result, 2 adjacent select switches Sj are put in a conductive state during the precharge period. During the voltage setting period, on the other hand, only 1 select switch Sj is put in a conductive state. As a result, the voltage-response time constant of the output voltage Vo during the precharge period is about ½ of the voltage-response time constant of the output voltage vo during the voltage setting period.

Since the response time constant of a load capacitor in the embodiment of the present invention can be reduced, the resistance of the select switch Sj can be increased accordingly. As a result, the area occupied by the select switch Sj and, hence, the circuit size can be reduced.

Figures 8A, 8B:
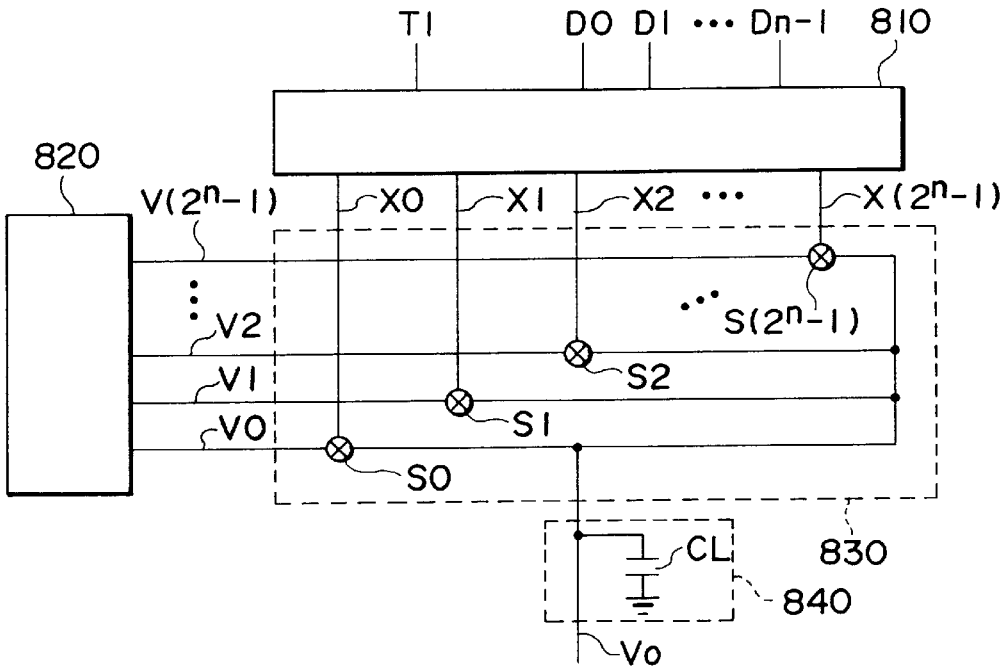
FIG. 8A is a block diagram showing the configuration of a fourth embodiment implementing a digital-to-analog conversion circuit provided by the present invention and FIG. 8B shows a truth table of a decoder employed in the digital-to-analog conversion circuit.

FIG. 8A is a block diagram showing the configuration of a fourth embodiment implementing a digital-to-analog conversion circuit provided by the present invention and FIG. 8B shows a truth table of a decoder employed in the digital-to-analog conversion circuit. As shown in FIG. 8A, the fourth embodiment comprises a decoder 810, a reference-voltage generation circuit 820, a voltage select circuit 830 and a load circuit 840. The decoder 810 inputs n image-data bits D0 to D(n−1) and a control signal T1, outputting N switch control signals X0 to X(N-1) to N select switches S0 to S(N−1) of the voltage select circuit 830 respectively where N is the nth power of 2. The reference-voltage generation circuit 820 outputs N reference voltages V0 to V(N−1) to the select switches S0 to S(N−1) of the voltage select circuit 830 respectively. The select switches S0 to S(N−1) are controlled by the switch control signals X0 to X(N−1) respectively to select one of the reference voltages V0 to V(N−1) as a voltage Vo. The load circuit 840 is represented by an equivalent capacitor CL connected to the output of the voltage select circuit 830.

The truth table shown in FIG. 8B represents relations of the control signal T1 and the n image-data bits D0 to D(n−1) versus the switch control signals X0 to X(N−1) of the decoder 810. As shown in the upper portion of the table, with the control signal T1 set at the "L" level, the n image-data bits D0 to D(n−1) set one of the switch control signals X0 to X(N−1) to a "H" level. As shown in the lower portion of the table, with the control signal T1 set at the "H" level, on the other hand, the n image-data bits D0 to D(n−1) set 2 adjacent ones of the N switch control signals X0 to X(N−1) to a "H" level.

As described above, the switch control signals Xj for determining the select switches Sj can be selected by the control signal T1 even for n input image-data bits. As a result, the same effects as the third embodiment shown in FIG. 9 can be obtained.

Figure 13:
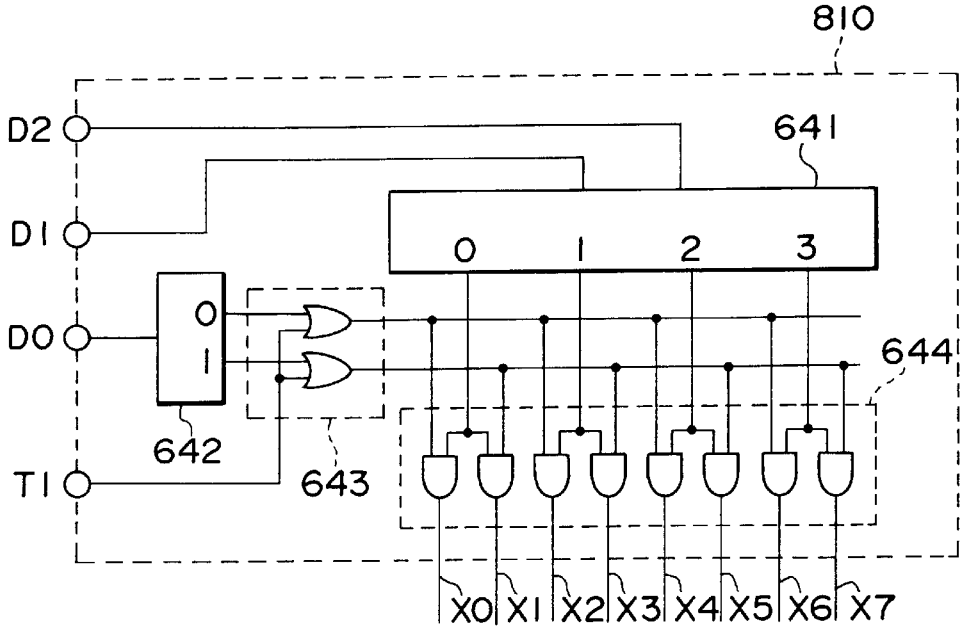
FIG. 13 is a block diagram showing the configuration of an embodiment implementing a decoder employed in the digital-to-analog conversion circuit provided by the present invention.

FIG. 13 is a block diagram showing the configuration of an embodiment implementing the decoder employed in the digital-to-analog conversion circuit provided by the present invention.

As shown in the figure, the decoder 810 comprises an upper-order-bit decoder 641 for decoding 2 high-order bits of the image data, a lower-order-bit decoder 642 for decoding the lowest-order bit of the image data, a plurality of OR gates 643 and a plurality of AND gates 644. To be more specific, the upper-order-bit decoder 641 decodes the image-data bits D1 and D2 whereas the lower-order-bit decoder 642 decodes the image-data bit D0. The OR gates 643 each input the control signal T1 and one of signals output by the lower-order-bit decoder 642. Each of the AND gates 644 inputs one of signals output by the OR gates 643 and one of signals output by the upper-order-bit decoder 641.

By configuring the decoder 810 as described above, the truth table of FIG. 10 for the decoder 810 shown in FIG. 9 is applicable. By dividing the decoder of the embodiment into the upper-order-bit decoder 641 and the lower-order-bit decoder 642 as described above, it is possible to give an effect of a reduced number of transistors used in the whole decoder.

Figure 14:
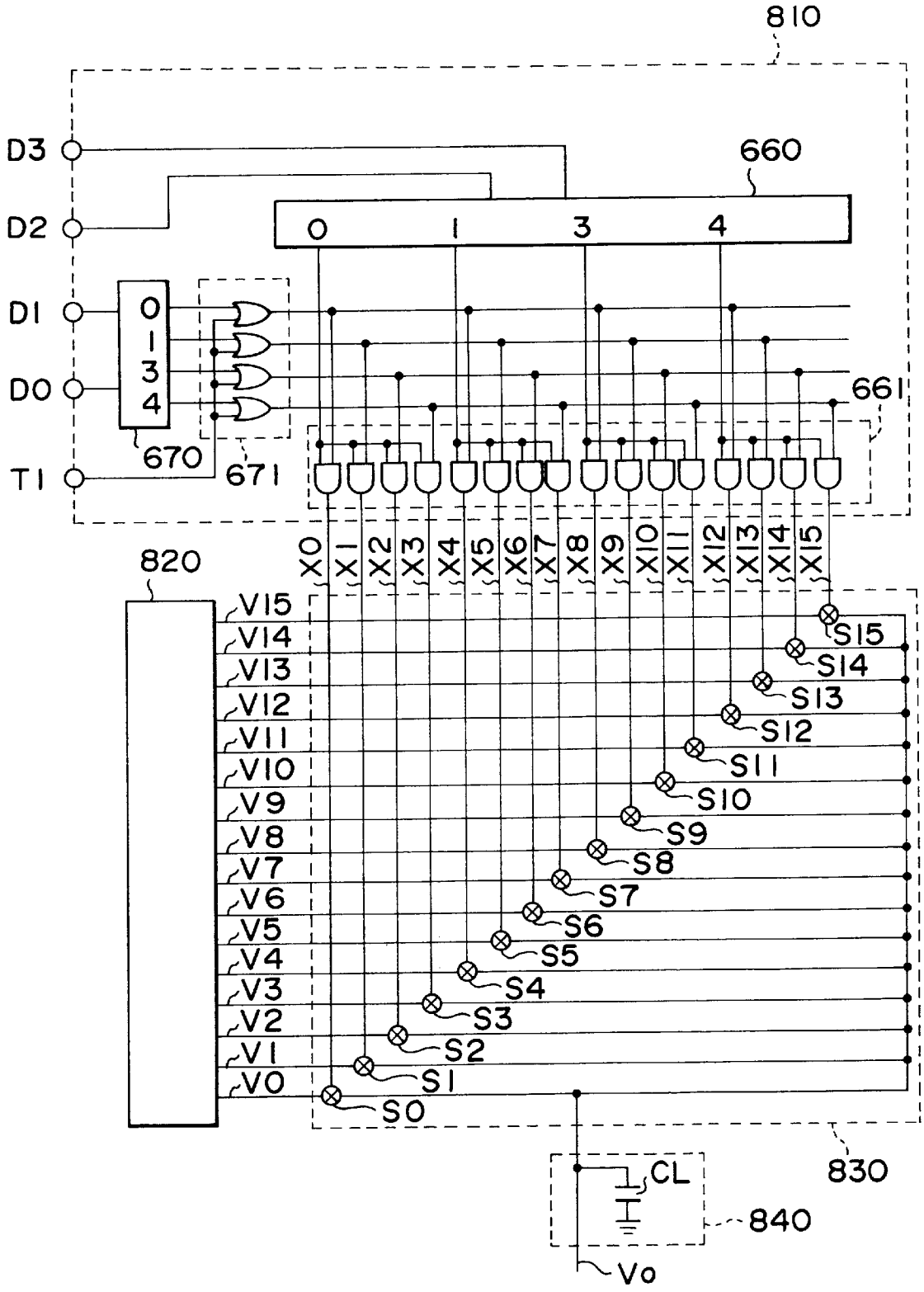
FIG. 14 is a block diagram showing the configuration of a fifth embodiment implementing a digital-to-analog conversion circuit provided by the present invention.

FIG. 14 is a block diagram showing the configuration of a fifth embodiment implementing a digital-to-analog conversion circuit provided by the present invention.

As shown in the figure, the fifth embodiment comprises a decoder 810, a reference-voltage generation circuit 820, a voltage select circuit 830 and a load circuit 840. The decoder 810 inputs 4 image-data bits D0 to D3 and a control signal T1, outputting 16 (the 4th power of 2) switch control signals X0 to X15 to 16 select switches S0 to S15 of the voltage select circuit 830 respectively. The reference-voltage generation circuit 820 outputs 16 reference voltages V0 to V15 to the select switches S0 to S15 of the voltage select circuit 830 respectively. The select switches S0 to S15 are controlled by the switch control signals X0 to X15 respectively to select one of the reference voltages V0 to V15 as a voltage Vo. The load circuit 840 is represented by an equivalent capacitor CL connected to the output of the voltage select circuit 830. The decoder 810 shown in FIG. 14 comprises an upper-order-bit decoder 660 for decoding 2 high-order bits of the image data, a lower-order-bit decoder 670 for decoding 2 lower-order bits of the image data, a plurality of OR gates 671 and a plurality of AND gates 661. To be more specific, the upper-order-bit decoder 660 decodes the image-data bits D3 and D2 whereas the lower-order-bit decoder 670 decodes the image-data bits D1 and D0. The OR gates 671 each input the control signal T1 and one of signals output by the lower-order-bit decoder 670. Each of the AND gates 661 inputs one of signals output by the OR gates 671 and one of signals output by the upper-order-bit decoder 660.

FIG. 15 shows a truth table used in the decoder 810 employed in the digital-to-analog conversion circuit provided by the present invention. The truth table shows only relations for the control signal T1 set at the "H" level. As shown in the figure, the select switches X0 to X15 are grouped into 4 sets each comprising 4 adjacent switches which are all put in either a conductive state or an nonconductive state. By increasing the number of select switches Xj in this way, it is possible to provide an effect of further shortening the electrical-charging time to ¼.

Figure 16:
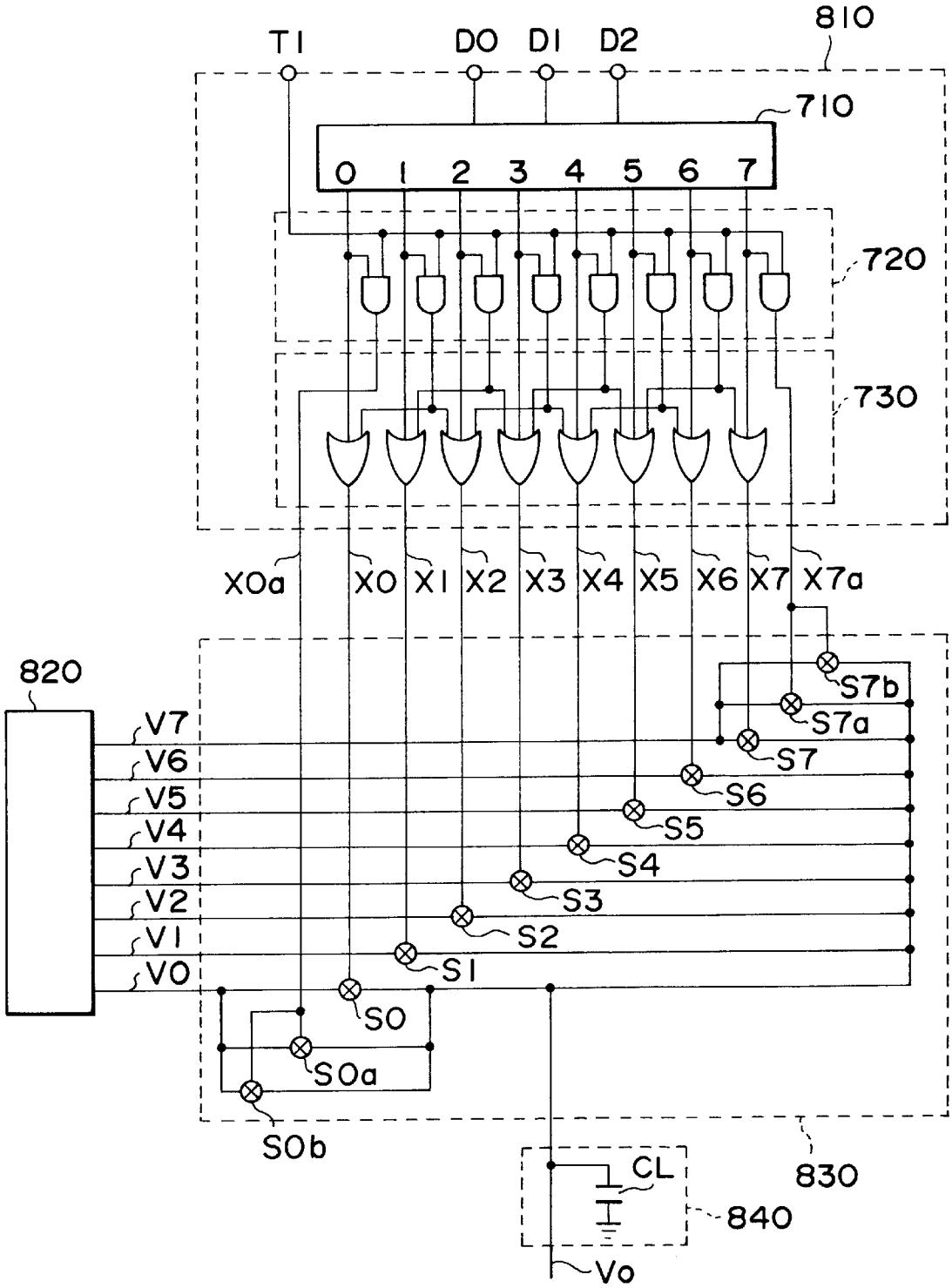
FIG. 16 is a block diagram showing the configuration of a sixth embodiment implementing a digital-to-analog conversion circuit provided by the present invention.

FIG. 16 is a block diagram showing the configuration of a sixth embodiment implementing a digital-to-analog conversion circuit provided by the present invention. As shown in the figure, the sixth embodiment comprises a decoder 810, a reference-voltage generation circuit 820, a voltage select circuit 830 and a load circuit 840.

The decoder 810 comprises a 3-bit decoder 710, a plurality of AND gates 720 and a plurality of OR gates 730. The 3-bit decoder 710 decodes the image-data bits D0 to D2. Each of the AND gates 720 inputs the control signal T1 and one of outputs of the 3-bit decoder 710. Each of the OR gates 730 inputs one of outputs of the AND gates 720 and one of the outputs of the 3-bit decoder 710, outputting switch control signals X0 to X7.

The decoder 810 also outputs switch control signals X0*a* and X7*a* in addition to the switch control signals X0 to X7. The switch control signals X0 to X7 are output to 8 select switches S0 to S7 of the voltage select circuit 830 respectively. On the other hand, the switch control signal X0*a* is output to select switches S0*a* and S0*b* of the voltage select circuit 830 whereas the switch control signal X7*a* is output to select switches S7*a* and S7*b* of the voltage select circuit 830. The reference-voltage generation circuit 820 outputs 8 reference voltages V0 to V7 to the select switches S0 to S7 of the voltage select circuit 830 respectively. The reference voltage V0 is also supplied to the select switches S0*a* and S0*b* whereas the reference voltage V7 is also supplied to the select switches S7*a* and S7*b*. The select switches S0 to S15 are controlled by the switch control signals X0 to X15 respectively and, on the other hand, the select switches S0*a* and S0*b* are controlled by the switch control signal X0*a* whereas the select switches S7*a* and S7*b* are controlled by the switch control signal and X7*a* to select one of the reference voltages V0 to V7 as a voltage Vo. The switch control signal X0*a* for controlling the select switches S0*a* and S0*b* is a logical product of the output of pin 0 of the 3-bit decoder 710 and the control signal T1 produced by the AND gate 720. On the other hand, the switch control signal X7*a* for controlling the select switches S7*a* and S7*b* is a logical product of the output of pin 7 of the 3-bit decoder 710 and the control signal T1 produced by the AND gate 720. The load circuit 840 is represented by an equivalent capacitor CL connected to the output of the voltage select circuit 830.

FIG. 17 shows a truth table used in the decoder 810 with the configuration described above. As shown in the figure, with the control signal T1 set at the "L" level, the 3 image-data bits D0 to D2 select one of the 8 switch control signals X0 to X7. With the control signal T1 set at the "H" level, on the other hand, the 3 image-data bits D0 to D2 select 3 adjacent ones of the switch control signals X0*a* (X0*b*), X0 to X7 and X7*a*(X7*b*). As a result, since the set value of the precharge period can be made all but equal to the set value of the voltage setting period, there is exhibited an effect of shortening the voltage setting period.

Figure 18:
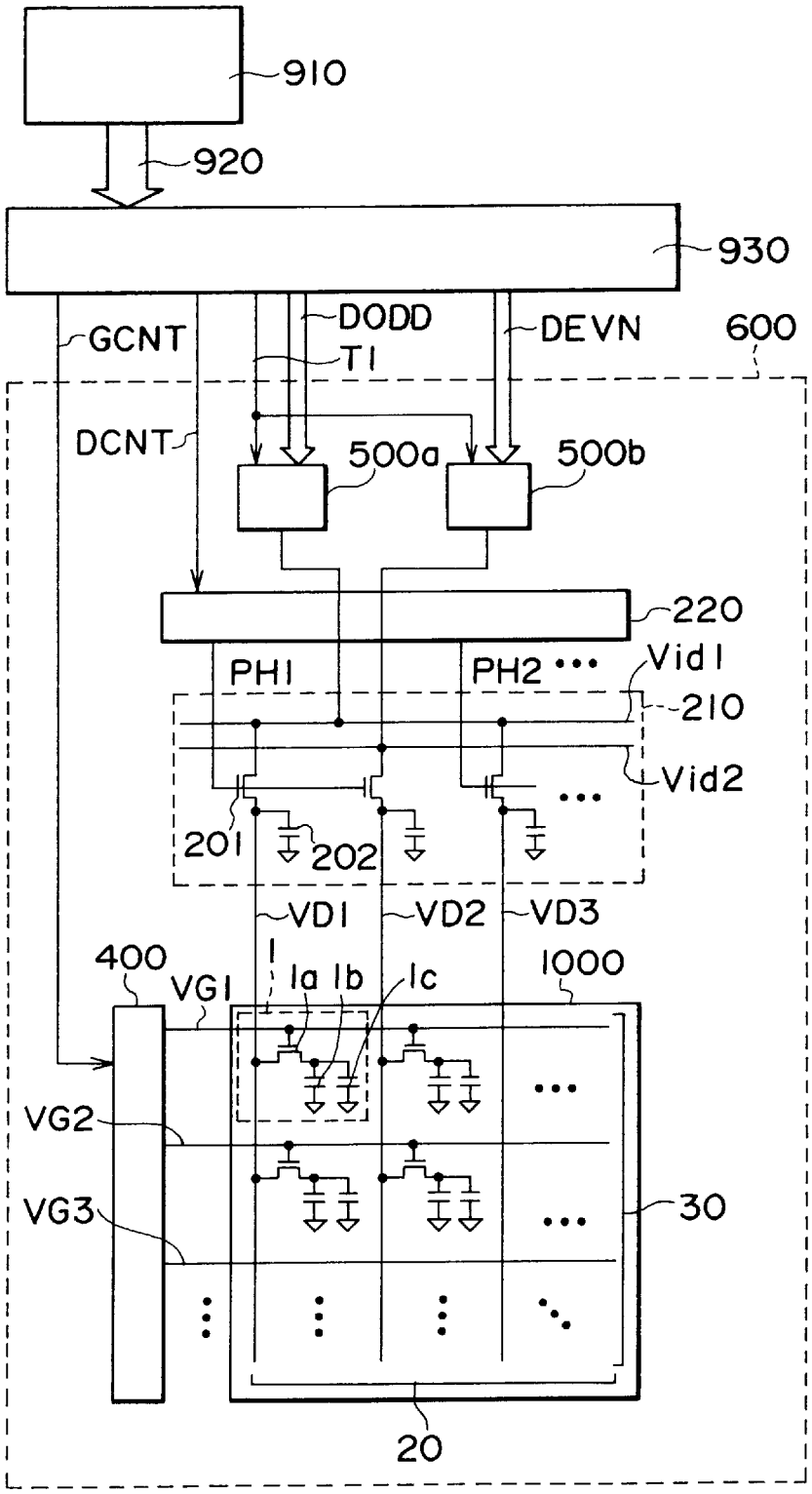
FIG. 18 is a block diagram showing the configuration of a third embodiment implementing a liquid-crystal display apparatus employing a digital-to-analog conversion circuit provided by the present invention.

FIG. 18 is a block diagram showing the configuration of a third embodiment implementing a liquid-crystal display apparatus employing a digital-to-analog conversion circuit provided by the present invention. As shown in the figure, the liquid-crystal display apparatus comprises a picture-signal source 910, an interface circuit 930 and a liquid-crystal panel 600.

The liquid-crystal panel 600 comprises a display unit 1000 including a matrix of pixel circuits 1, a vertical drive circuit 400 for driving a plurality of scan lines 30, a sample-and-hold circuit 210 for driving a plurality of data lines 20, a horizontal vertical drive circuit 220 for controlling sampling timing of the sample-and-hold circuit 210 and digital-to-analog conversion circuits 500*a* and 500*b* each for converting a digital picture signal into an analog picture signal supplied to the sample-and-hold circuit 210. The digital-to-analog conversion circuits 500*a* and 500*b* input image data from even-numbered and odd-numbered lines respectively, driving a video data line of the sample-and-hold circuit 210.

Each of the pixel circuits 1 comprises a MOS transistor 1*a*, a holding capacitor 1*b* and a liquid-crystal capacitor 1*c*. The gate electrode and the drain electrode of the MOS transistor la are connected to one of the scan lines 30 and one of the data lines 20 respectively whereas the source electrode thereof is connected to the holding capacitor 1*b* and the liquid-crystal capacitor 1*c*. The other terminals of the holding capacitor 1*b* and the liquid-crystal capacitor 1*c* are set at the same electric potential as an electrode of a facing substrate which faces the display unit 1000 and sandwiches a liquid-crystal in conjunction with the display unit 1000. The sample-and-hold circuit 210 comprises a MOS transistor 201 and a capacitor 202 for each of the data lines 20. The drain electrode of the MOS transistor 201 is connected to an odd-numbered or even-numbered data line 20 whereas the source electrode thereof is connected to a picture line V1 or V2 of the video data line respectively so that, when the MOS transistor is turned on, the picture line V1 or V2 is output to the odd-numbered or even-numbered data line 20 respectively. The gate electrode of the MOS transistor 201 is connected to one of outputs of the horizontal vertical drive circuit 220.

In the liquid-crystal display apparatus with the configuration described above, the output load of the digital-to-analog conversion circuits 500*a* and 500*b* comprises the video data lines and the data lines 20. Since the digital-to-analog conversion circuits 500*a* and 500*b* are each the digital-to-analog conversion circuit provided by the present invention, however, electric charging can be carried out at a high speed so that the select switches are each allowed to have a high resistance. As a result, there is exhibited an effect of a reduced area occupied by the select switches.

Since the data lines in the liquid-crystal display apparatus provided by the present invention can be driven at a high speed and the area occupied by the drive circuit can be reduced, there is exhibited an effect of an ability to produce a sufficiently high picture quality even for a liquid-crystal display apparatus with a high resolution and a large screen.

What is claimed is:

1. A liquid-crystal display apparatus comprising a first substrate, a second substrate and a liquid-crystal sandwiched by said first and said second substrates, wherein:

a switching element is created at a cross point of a scan line and a data line on said first substrate;

a vertical drive circuit for controlling a voltage of said scan line is created on said first substrate;

a horizontal drive circuit for controlling a voltage of said data line is created on said first substrate;

a transparent electrode is created on one of said surfaces of said second substrate;

said horizontal drive circuit comprises:

a reference-voltage generation means for generating a plurality of voltages;

a voltage select means including a plurality of voltage select switches for selecting a specific voltage corresponding to image data among said voltages generated by said reference-voltage generation means;

a control means for controlling said voltage select means in accordance with said image data supplied thereto; and a sample-and-hold means for sampling said specific voltage output by said voltage select means with predetermined timing; and said control means has:

a first state for charging said data line by turning on at least a plurality of said voltage select switches; and a second state for turning on a smaller number of said voltage select switches than said voltage select switches turned on in said first state;

wherein the number of said voltage select switches turned on by said control means in said first state is at least 2 and the number of said voltage select switches turned on in said second state is 1; and wherein an average of said reference voltages selected by putting said voltage select switches turned-on in said first state is almost equal to an average of said reference voltages selected by putting said voltage select switches turned-on in said second state.

2. A liquid-crystal display apparatus comprising a first substrate, a second substrate and a liquid-crystal sandwiched by said first and said second substrates, wherein:

a switching element is created at a cross point of a scan line and a data line on said first substrate;

a vertical drive circuit for controlling a voltage of said scan line is created on said first substrate;

a horizontal drive circuit for controlling a voltage of said data line is created on said first substrate;

a transparent electrode is created on one of said surfaces of said second substrate;

said horizontal drive circuit comprises:

a reference-voltage generation means for generating a plurality of voltages;

a voltage select means including a plurality of voltage select switches for selecting a specific voltage corresponding to image data among said voltages generated by said reference-voltage generation means;

a control means for controlling said voltage select means in accordance with said image data supplied thereto; and a sample-and-hold means for sampling said specific voltage output by said voltage select means with predetermined timing; and said control means has:

a first state for charging said data line by turning on at least a plurality of said voltage select switches; and a second state for turning on a smaller number of said voltage select switches than said voltage select switches turned on in said first state;

wherein the number of said voltage select switches turned on by said control means in said first state is at least 2 and the number of said voltage select switches turned on in said second state is 1;

wherein said voltage select switches are organized into N voltage-select-switch sets each comprising M voltage select switches where M and N are each an integer at least equal to 2 and said voltage select switches turned on by said control means in said first state include said switches turned on in said second state;

wherein the number (M) of voltage select switches turned on in said first state by said control means is the nth power of 2 where n is an integer; and wherein said control means includes a decoder for receiving j-bit image data and logically inverted data of said image data and decoding said j bits into one of k possible outputs, where k is the jth power of 2, and logical sums of low-order n bits of said image data, where $1 \leqq n < j$ and a control signal T3 as well as logical sums of logically inverted data of said low-order n bits of said image data and said control signal T1 are supplied to said decoder.

3. A liquid-crystal display apparatus comprising a first substrate, a second substrate and a liquid-crystal sandwiched by said first and said second substrates, wherein:

a switching element is created at a cross point of a scan line and a data line on said first substrate;

a vertical drive circuit for controlling a voltage of said scan line is created on said first substrate;

a horizontal drive circuit for controlling a voltage of said data line is created on said first substrate;

a transparent electrode is created on one of said surfaces of said second substrate;

said horizontal drive circuit comprises:

a reference-voltage generation means for generating a plurality of voltages;

a voltage select means including a plurality of voltage select switches for selecting a specific voltage corresponding to image data among said voltages generated by said reference-voltage generation means;

a control means for controlling said voltage select means in accordance with said image data supplied thereto; and a sample-and-hold means for sampling said specific voltage output by said voltage select means with predetermined timing; and said control means has:

a first state for charging said data line by turning on at least a plurality of said voltage select switches; and a second state for turning on a smaller number of said voltage select switches than said voltage select switches turned on in said first state;

wherein the number of said voltage select switches turned on by said control means in said first state is at least 2 and the number of said voltage select switches turned on in said second state is 1;

wherein said voltage select switches are organized into N voltage-select-switch sets each comprising M voltage select switches where M and N are each an integer at least equal to 2 and said voltage select switches turned on by said control means in said first state include said switches turned on in said second state;

wherein the number (M) of voltage select switches turned on in said first state by said control means is the nth power of 2 where n is an integer;

wherein the number of said voltage select switches turned on in said first state is an odd number;

wherein said voltage select switches turned on in said first state are said voltage select switches turned on in said second state, said voltage select switches each selecting a voltage higher than voltages selected by said voltage select switches turned on in said second state and said voltage select switches each selecting a voltage lower than voltages selected by said voltage select switches turned on in said second state;

wherein said voltage select switches turned on in said first state are adjacent to each other;

wherein the number of said voltage select switches turned on in said first state is 3; and wherein said control circuit includes a decoder for decoding j-bit image data into one of k possible outputs, where k is jth power of 2, 2-input logical-product circuits and 3 input logical-sum circuits;

inputs to each of said 2-input logical-product circuits are one of said outputs of said decoder and said control signal T1; and inputs to each of said 3-input logical-sum circuits are one of said outputs of said decoder and outputs of two adjacent ones of said 2-input logical-product circuits.

* * * * *